US008296110B2

(12) United States Patent
Nagai et al.

(10) Patent No.: US 8,296,110 B2
(45) Date of Patent: Oct. 23, 2012

(54) FORMING CONDITION DETERMINATION METHOD AND FORMING CONDITION DETERMINATION SYSTEM

(75) Inventors: Yuichi Nagai, Tochigi (JP); Hideo Meguri, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 673 days.

(21) Appl. No.: 12/443,914

(22) PCT Filed: Oct. 4, 2007

(86) PCT No.: PCT/JP2007/069470

§ 371 (c)(1),
(2), (4) Date: Apr. 1, 2009

(87) PCT Pub. No.: WO2008/041745

PCT Pub. Date: Apr. 10, 2008

(65) Prior Publication Data

US 2010/0089119 A1 Apr. 15, 2010

(30) Foreign Application Priority Data

Oct. 4, 2006 (JP) ..... 2006-273022
Jan. 23, 2007 (JP) ..... 2007-012822
Jun. 8, 2007 (JP) ..... 2007-153295

(51) Int. Cl.
*G06G 7/48* (2006.01)
*G06F 19/00* (2006.01)

(52) U.S. Cl. ..... 703/8; 703/7; 700/146

(58) Field of Classification Search ..... 703/7, 8, 703/6; 73/9, 865, 818; 700/145, 146; 164/284; 100/76, 84, 303–305, 4, 5
See application file for complete search history.

(56) References Cited

U.S. PATENT DOCUMENTS 3,841,140 A * 10/1974 Hryc ..... 72/441
(Continued)

FOREIGN PATENT DOCUMENTS

CN 1137955 C 2/2004
(Continued)

OTHER PUBLICATIONS

Gutscher, Gerhard, et al. "Determination of Flow Stress for Sheet Metal Forming Using the Viscous Pressure Bulge (VPB) Test", 2004, Journal of Materials Processing Technology 146, Elsevier B.V.*

(Continued)

*Primary Examiner* — Kandasamy Thangavelu
*Assistant Examiner* — Cedric D Johnson
(74) *Attorney, Agent, or Firm* — Rankin, Hill & Clark LLP

(57) ABSTRACT

A forming speed determination method for determining a forming speed of a press-processing device with a plurality of measurement points on a sheet material to conduct press-forming of the sheet material with a press-processing device at a predetermined forming speed. Strain states at respective points on the press-formed sheet material are plotted on a forming limit diagram including the forming limit curve of a sheet material to produce a strain distribution chart. Subsequently, the closest point to the forming limit curve among the points is defined as a specific measurement point. When this specific measurement point is located in the bulge region, the forming speed of a press-processing device is decreased to be slower than the above-mentioned predetermined forming speed. Meanwhile, when this specific measurement point is located in the draw region, the forming speed of a press-processing device is increased to be faster than the above-mentioned predetermined forming speed.

2 Claims, 48 Drawing Sheets

U.S. PATENT DOCUMENTS

| | | | | |
|---|---|---|---|---|
| 5,100,113 | A * | 3/1992 | Imanishi | 267/119 |
| 5,339,665 | A * | 8/1994 | Yoshikawa | 72/20.1 |
| 6,915,244 | B2 * | 7/2005 | Yamano et al. | 703/2 |
| 2003/0010078 | A1 * | 1/2003 | Koyama et al. | 72/31.1 |
| 2003/0069662 | A1 * | 4/2003 | Chebbi | 700/165 |
| 2003/0182005 | A1 * | 9/2003 | Chu et al. | 700/97 |
| 2004/0094046 | A1 * | 5/2004 | Aoshima et al. | 100/218 |
| 2005/0257697 | A1 * | 11/2005 | Futamura et al. | 100/46 |
| 2006/0116466 | A1 * | 6/2006 | Kadowaki et al. | 524/495 |
| 2007/0009757 | A1 * | 1/2007 | Takayama et al. | 428/644 |

FOREIGN PATENT DOCUMENTS

| | | |
|---|---|---|
| JP | 07-301189 | 11/1995 |
| JP | 2000-107818 | 4/2000 |
| JP | 2000-249636 | 9/2000 |
| JP | 2001-096314 | 4/2001 |
| JP | 2005-125355 | 5/2005 |
| JP | 2006-231377 | 9/2006 |

OTHER PUBLICATIONS

Tekkaya, A. Erman, "State-of-the-Art of Simulation of Sheet Metal Forming", 2000, Journal of Materials Processing Technology 103, Elsevier Science S.A.*

Chinese Publication No. 101522332 (B) dated Feb. 15, 2012, Applicant—Honda Motor Co., Ltd., three pages.

* cited by examiner

FIG. 26

| STRAIN RATE | DATA NO. |
|---|---|
| 0.01 | 1 |
| 0.1 | 2 |
| 1 | 3 |
| 10 | 4 |

DATA1

| EQUIVALENT PLASTIC STRAIN | EQUIVALENT STRESS |
|---|---|
| 0 | 18 |
| 0.05 | 19.5 |
| 0.1 | 20.7 |
| 0.15 | 21.6 |
| 0.2 | 22.3 |
| 0.25 | 22.9 |
| 0.3 | 23.4 |
| ⋮ | ⋮ |

DATA2

| EQUIVALENT PLASTIC STRAIN | EQUIVALENT STRESS |
|---|---|
| 0 | 19.5 |
| 0.05 | 21 |
| 0.1 | 22.2 |
| 0.15 | 23.1 |
| 0.2 | 23.8 |
| 0.25 | 24.4 |
| 0.3 | 24.9 |
| ⋮ | ⋮ |

FIG. 30

| CONTACT PRESSURE | DATA NO. |
|---|---|
| 1 | 1 |
| 2 | 2 |
| 5 | 3 |
| 10 | 4 |

DATA1

| SLIDE SPEED | FRICTION COEFFICIENT |
|---|---|
| 1 | 0.135 |
| 5 | 0.133 |
| 10 | 0.131 |
| 50 | 0.129 |
| 100 | 0.127 |
| 200 | 0.125 |

DATA2

| SLIDE SPEED | FRICTION COEFFICIENT |
|---|---|
| 1 | 0.155 |
| 5 | 0.154 |
| 10 | 0.153 |
| 50 | 0.152 |
| 100 | 0.151 |
| 200 | 0.15 |

FIG. 43

| STRAIN RATE | DATA NO. |
|---|---|
| 0.01 | 1 |
| 0.1 | 2 |
| 1 | 3 |
| 10 | 4 |

DATA1

| EQUIVALENT PLASTIC STRAIN | EQUIVALENT STRESS |
|---|---|
| 0 | 18 |
| 0.05 | 19.5 |
| 0.1 | 20.7 |
| 0.15 | 21.6 |
| 0.2 | 22.3 |
| 0.25 | 22.9 |
| 0.3 | 23.4 |
| ▪ | ▪ |
| ▪ | ▪ |
| ▪ | ▪ |

DATA2

| EQUIVALENT PLASTIC STRAIN | EQUIVALENT STRESS |
|---|---|
| 0 | 19.5 |
| 0.05 | 21 |
| 0.1 | 22.2 |
| 0.15 | 23.1 |
| 0.2 | 23.8 |
| 0.25 | 24.4 |
| 0.3 | 24.9 |
| ▪ | ▪ |
| ▪ | ▪ |
| ▪ | ▪ |

FIG. 47

| CONTACT PRESSURE | DATA NO. |
|---|---|
| 1 | 1 |
| 2 | 2 |
| 5 | 3 |
| 10 | 4 |

DATA1

| SLIDE SPEED | FRICTION COEFFICIENT |
|---|---|
| 1 | 0.135 |
| 5 | 0.133 |
| 10 | 0.131 |
| 50 | 0.129 |
| 100 | 0.127 |
| 200 | 0.125 |

DATA2

| SLIDE SPEED | FRICTION COEFFICIENT |
|---|---|
| 1 | 0.155 |
| 5 | 0.154 |
| 10 | 0.153 |
| 50 | 0.152 |
| 100 | 0.151 |
| 200 | 0.15 |

FORMING CONDITION DETERMINATION METHOD AND FORMING CONDITION DETERMINATION SYSTEM

TECHNICAL FIELD

The present invention relates to a forming condition determination method and a forming condition determination system that determine the forming conditions of a pressing machine.

BACKGROUND ART

It has been well known conventionally that the forming speed have a major impact on the quality of a formed article in press-processing. Therefore, a press method and a press device that control the forming speed to prevent cracks, wrinkles, dimensional accuracy defects, and the like that occur in a formed article are proposed (refer to the patent document 1). According to the press method and the press device described in the patent document 1, the forming speed is controlled so that the ratio of the distance of an upper die mechanism to the inflow of a material falls within the predetermined appropriate range.

Patent Document 1: Unexamined Japanese Patent Application, First Publication No. 2005-125355

DISCLOSURE OF THE INVENTION

Problems to be Solved by the Invention

By the way, a formed article with a complex shape, such as a fuel tank of a motorcycle has a draw-formed part and a bulge-formed part. The optimum forming speeds of these two formings are unequal. Specifically, the inflow of a material increases at the increased forming speed, and it is thus preferable that the draw-formed part is press-formed at the increased forming speed. Meanwhile, the extension of a material increases at the decreased forming speed, and it is thus preferable that the bulge-formed part is press-formed at the decreased forming speed.

Accordingly, in press-forming, it is necessary to adjust the forming speed appropriately in accordance with whether draw-forming or bulge-forming is predominant. However, in the forming speed determination method described in the patent document 1, the forming speed for forming such a formed article appropriately with a complex shape cannot be determined. Therefore, in this case, the forming speed is often empirically determined by an operator, so that it may take time to determine the forming speed.

In addition, in the pressing machine capable of changing the forming speed and the fold pressure during forming, such as a servo pressing machine, the combinations of the configurable forming speed and the configurable fold pressure are varied. Therefore, in the case in which the optimum combination of the forming speed and the fold pressure is determined, for example, determination of the forming speed based on experience of an operator as described above may need a lot of time, material, and cost.

An objective of the present invention is to provide a forming condition determination method and a forming condition determination system that determine the forming speed of a pressing machine appropriately and promptly.

Means for Solving the Problems

The forming condition determination method of the present invention is a forming condition determination method for determining a forming speed of a pressing machine (for example, the below-mentioned pressing machine 110), comprising: a test press-forming step of providing a plurality of measurement points on a sheet material (for example, the below-mentioned steel sheet 112) to conduct press-forming of the sheet material with the pressing machine at a predetermined forming speed; a strain distribution chart plotting step of plotting a strain state at each of the measurement points on the press-formed sheet material on forming limit diagram including a forming limit curve of the sheet material to produce a strain distribution chart; and a forming speed determination step of defining the closest point plotted on the strain distribution diagram to the forming limit curve (for example, the below-mentioned forming limit curve FL) as a specific measurement point (for example, the below-mentioned point $Q_A$), decreasing the forming speed to be slower than the predetermined forming speed when the specific measurement point is located in a bulge region, and increasing the forming speed to be faster than the predetermined forming speed when the specific measurement point is located in a draw region.

The bulge region is a bulge-formed region; specifically a region in which a maximum principal strain and a minimum principal strain are positive. The draw region is a draw-formed region; specifically a region in which a maximum principal strain is positive and a minimum principal strain is negative. According to the present invention, among strain states at the respective measurement points on the press-formed sheet material, the closest strain to the forming limit curve of this sheet material is defined as a specific measurement point. When the specific measurement point belongs to the bulge region, it is assumed that the bulge-forming is predominant in this formed article, and thus the forming speed is decreased. Meanwhile, when the specific measurement point belongs to the draw region, it is assumed that draw-forming is predominant in this formed article, and thus the forming speed is increased. That is, the forming speed is decreased or increased in accordance with whether the specific measurement point belongs to the bulge region or the draw region. Therefore, the forming speed of a pressing machine can be determined appropriately and promptly in accordance with the material of a sheet material and the shape of a formed article, compared with the case to determine the forming speed based on intuition and experience of an operator in a conventional way.

The forming condition determination system of the present invention (for example, the below-mentioned forming condition determination system 201) is a forming condition determination system determining the forming condition of a pressing machine (for example, the below-mentioned pressing machine 230) conducting press-forming of a sheet material (for example, the below-mentioned steel sheet 232), comprising: a forming simulation means (for example, the below-mentioned forming simulation means 215) for conducting forming simulation under the forming condition including a forming speed; a strain distribution chart plotting means (for example, the below-mentioned strain distribution chart plotting means 216) for plotting a strain state at each of elements on the press-formed sheet material on a forming limit diagram including a forming limit curve to produce a strain distribution chart, based on the result from the forming simulation means; a determination means (for example, the below-mentioned determination means 217) for extracting the most crackable point among the plotted points as a maximum crack risk point (for example, the below-mentioned maximum crack risk point $Q_A$) based on the relative position relationship between a point plotted by the strain distribution chart plotting means and the forming limit curve to determine whether or not the quality of a press-formed article satisfies a certain standard; and a forming speed fluctuation means (for example, the below-mentioned forming speed fluctuation means 218) for, when the determination means determines that the quality of a press-formed article unsatisfies a certain standard, increasing the forming speed to set the forming condition in the case in which the minimum principal strain at the maximum crack risk point is 0 or less, and decreasing the forming speed to set the forming condition in the case in which the minimum principal strain at the maximum crack risk point is greater than 0, wherein the forming simulation means, the strain distribution chart plotting means, and the determination means are repeated in order until the determination means determines that the quality satisfies a certain standard.

The region in which the minimum principal strain is greater than 0 is a bulge-formed region. Meanwhile, the region in which the minimum principal strain is 0 or less is a draw-formed region. According to the present invention, the forming simulation means conducts forming simulation, and then the strain distribution chart plotting means produces a strain distribution char based on the result from the forming simulation. Then, the determination means extracts the most crackable point as a maximum crack risk point among the points plotted on the strain distribution chart. The quality of a formed article is determined on this basis.

At this point, when it is determined that the quality of a formed article unsatisfies a certain standard, and when the minimum principal strain at the maximum crack risk point is 0 or less, it is assumed that draw-forming is predominant in this formed article, and thus the forming speed fluctuation means increases the forming speed. Meanwhile, when it is determined that the quality of a formed article unsatisfies a certain standard, and when the minimum principal strain at the maximum crack risk point is greater than 0, it is assumed that bulge-forming is predominant in this formed article, and thus the forming speed fluctuation means decreases the forming speed.

These processes by the forming simulation means, the strain distribution chart plotting means, and the determination means are repeated until it is determined that the quality of a formed article satisfies a certain standard, whereby the optimum forming speed in accordance with the shape of a formed article is automatically determined. Therefore, the forming speed of a pressing machine can be determined appropriately and promptly, compared with the case to determine the forming speed based on intuition and experience of an operator in a conventional way. In addition, according to the present invention, the forming speed can be automatically determined, so that the number of times of trials using a real pressing machine and a real material can be reduced considerably, which leads to reduce the cost. Furthermore, the forming conditions are expected by using the forming condition determination system of the present invention during the stage of designing the shape of a product, whereby a product with a complex shape can be formed.

The forming condition determination system of the present invention (for example, the below-mentioned forming condition determination system 301) is a forming condition determination system determining the forming condition of a pressing machine (for example, the below-mentioned pressing machine 330), comprising: a the die cushion pressure optimization means (for example, the below-mentioned die cushion pressure optimization means 361) for optimizing die cushion pressure; a slide speed optimization means (for example, the below-mentioned slide speed optimization means 362) for optimizing the slide speed; and a forming condition determination means (for example, the below-mentioned forming condition determination means 363) for determining whether or not the quality of a press-formed article satisfies a certain standard based on the result of a forming simulation analysis, wherein the die cushion pressure optimization means, the forming condition determination means, the slide speed optimization means, and the forming condition determination means are repeated in order until the forming condition determination means determines that the quality of a press-formed article satisfies a certain standard.

According to the present invention, the die cushion pressure and the slide speed can be automatically determined, so that the forming speed of a pressing machine can be determined appropriately and promptly. Accordingly, the number of times of trials using a real pressing machine and a real material can be reduced considerably, which leads to reduce the cost. In addition, the forming conditions are expected during the stage of designing the shape of a product, whereby a product with a complex shape can be formed. Especially, in a servo pressing machine, the slide speed and the die cushion pressure can be freely changed during forming, so that the number of times of trials can be reduced considerably.

In this case, it is preferable that the forming condition determination means determines whether or not the quality of a press-formed article satisfies a certain standard, based on a minimum principal strain and a sheet thickness decrease rate, or a minimum principal strain and an equivalent plastic strain output as a result of the forming simulation analysis.

It is known that cracks (fissures) are generated more easily when the sheet thickness decrease rate and the equivalent plastic strain increase, and wrinkles and surface strain are generated more easily when the minimum principal strain decreases. Then, according to the present invention, in the forming condition determination means, it is determined whether or not the quality of a press-formed article satisfies a certain standard based on the minimum principal strain and the sheet thickness decrease rate, or the minimum principal strain and an equivalent plastic strain. Thus, the deficiency of a press-formed article is certainly predictable.

In this case, it is preferable that the system further comprises a forming simulation means (for example, the below-mentioned forming simulation means 312) for conducting forming simulation by using a stress-strain relation, wherein the forming simulation means determines the stress-strain relation at consideration of the strain rate.

In this case, it is preferable that the forming simulation means conducts forming simulation by using a friction coefficient, and the friction coefficient is determined in consideration of the slide speed and the contact pressure of a material with a die of a pressing machine.

In a conventional forming simulation, the friction coefficient is determined in accordance with the die shape, but the slide speed and the contact pressure of a material with a die are not considered. In addition, the stress-strain relation is not considered with the strain rate. Thus, it has been difficult to conduct forming simulation with high accuracy, for a servo pressing machine in which the slide speed and the die cushion pressure change during forming. According to the present invention, the friction coefficient is determined in consideration of the slide speed and the contact pressure of a material with a die of a pressing machine. In addition, the stress-strain relation is determined in consideration of the strain rate. Therefore, the forming simulation can be conducted with high accuracy for a servo pressing machine in which the slide speed and the die cushion pressure change.

The forming condition determination method of the present invention is a forming condition determination method for determining the forming condition of a pressing machine, comprising: a die cushion pressure optimization step of optimizing a die cushion pressure; a slide speed optimization step of optimizing a slide speed; a forming condition determination step of conducting a forming simulation analysis to determine whether or not the quality of a press-formed article satisfies a certain standard based on the result of the analysis, wherein the die cushion pressure optimization step, the forming condition determination step, the slide speed optimization step, and the forming condition determination step are repeated in order until in the forming condition determination step, it is determined that the quality of a press-formed article satisfies a certain standard.

In this case, it is preferable that in the forming condition determination step, it is determined whether or not the quality of a press-formed article satisfies a certain standard, based on a minimum principal strain and a sheet thickness decrease rate, or a minimum principal strain and an equivalent plastic strain output as a result of the forming simulation analysis.

In this case, in the forming condition determination step, it is preferable that the forming simulation is conducted by using a stress-strain relation, and the stress-strain relation is determined in consideration of the strain rate.

In this case, it is preferable that in the forming simulation step, forming simulation is conducted by using a friction coefficient, and the friction coefficient is determined in consideration of the slide speed and the contact pressure of a material with a die of a pressing machine.

The above-mentioned forming condition determination method of a pressing machine is developed from the above-mentioned forming condition determination system as the forming condition determination method of a pressing machine, which has similar effects to those of the above-mentioned forming condition determination system.

Effects of the Invention

According to the present invention, among strain states at the respective measurement points on the press-formed sheet material, the closest strain state to the forming limit curve of this sheet material is defined as a specific measurement point. When the specific measurement point belongs to the bulge region, it is assumed that the bulge-forming is predominant in this formed article, and thus the forming speed is decreased. Meanwhile, when the specific measurement point belongs to the draw region, it is assumed that draw-forming is predominant in this formed article, and thus the forming speed is increased. That is, the forming speed is decreased or increased in accordance with whether the specific measurement point belongs to the bulge region or the draw region. Therefore, the forming speed of a pressing machine can be determined appropriately and promptly in accordance with the material of a sheet material and the shape of a formed article, compared with the case to determine the forming speed based on intuition and experience of an operator in a conventional way.

According to the present invention, the forming speed of a pressing machine can be determined appropriately and promptly, compared with the case to determine the forming speed based on intuition and experience of an operator in a conventional way. In addition, according to the present invention, the forming speed can be automatically determined, so that the number of times of trials using a real pressing machine and a real material can be reduced considerably, which leads to reduce the cost. Furthermore, the forming conditions are expected by using the forming condition determination system of the present invention during the stage of designing the shape of a product, whereby a product with a complex shape can be formed.

According to the present invention, the die cushion pressure and the slid speed can be automatically determined, so that the number of times of trials using a real pressing machine and a real material can be reduced considerably, which leads to reduce the cost. In addition, the forming conditions are expected during the stage of designing the shape of a product, whereby a product with a complex shape can be formed. Especially, in a servo pressing machine, the slide speed and the die cushion pressure can be freely changed during forming, so that the number of times of trials can be reduced considerably.

BRIEF DESCRIPTION OF THE DRAWINGS

FIG. 26 is a diagram illustrating dot string data of the equivalent stress according to the embodiment;

FIG. 30 is a diagram illustrating dot string data of the friction coefficient according to the embodiment;

FIG. 43 is a diagram illustrating dot string data of the equivalent stress according to the embodiment;

FIG. 47 is a diagram illustrating dot string data of the friction coefficient according to the embodiment.

PREFERRED MODE FOR CARRYING OUT THE INVENTION

Each embodiment of the present invention is described below in more detail with reference to the accompanying drawings.

First Embodiment

Figure 1:
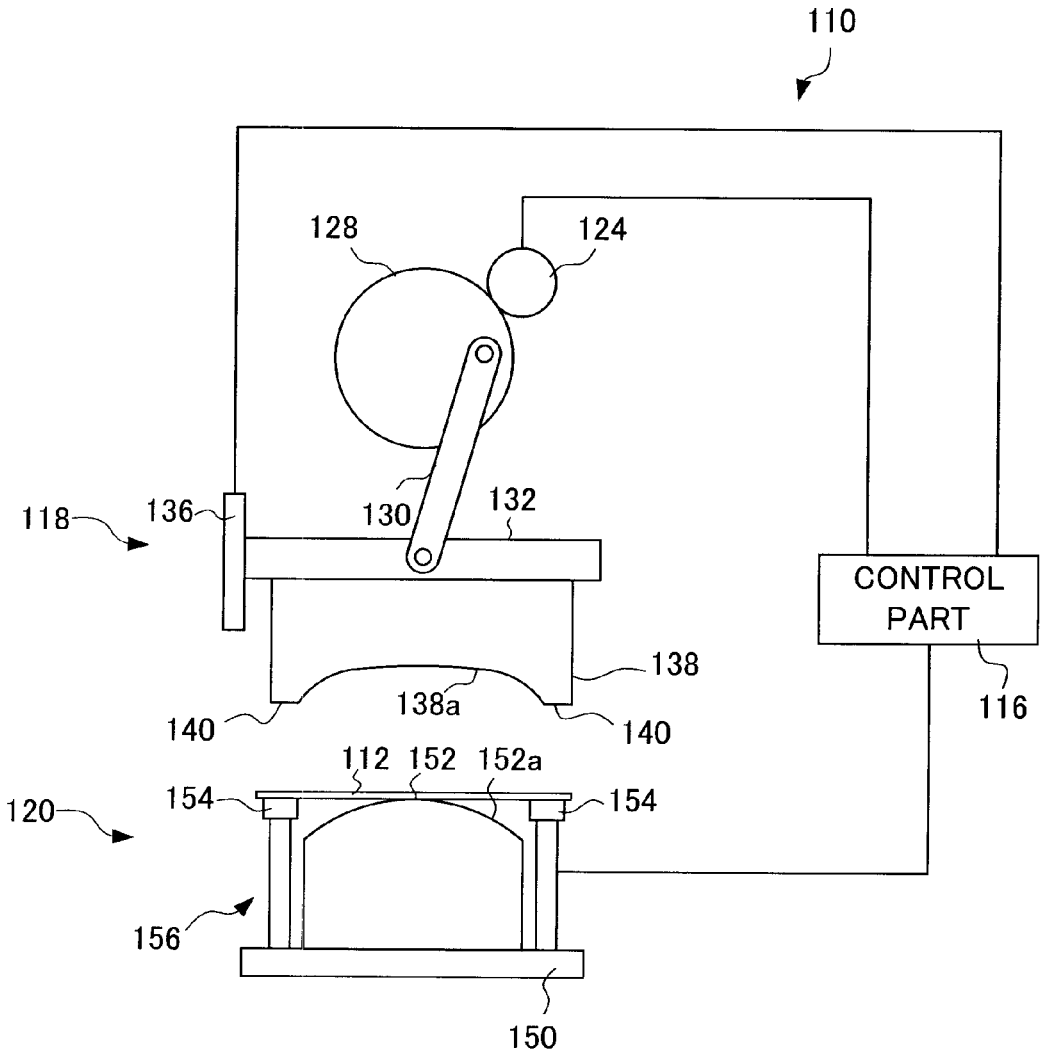
FIG. 1 is a pattern diagram illustrating the structure of a pressing machine according to the first embodiment of the present invention.

FIG. 1 is a pattern diagram illustrating the structure of the pressing machine 110 according to the first embodiment of the present invention. The pressing machine 110 has the lower die mechanism 120 having the lower die 152 placed at the lower side of a steel sheet 112, the upper die mechanism 118 bringing the upper die 138 to approach to and isolate from the lower die 152, the control part 116 controlling the lower die mechanism 120 and the upper die mechanism 118.

The upper die mechanism 118 has the servo motor 124, the rotating plate 128 rotarily driven by the servo motor 124 through a reduction gear (not shown), and the connecting rod 130, the top end part of which pivoted swingably with the side face of the rotating plate 128.

The servo motor 124 is of an AC type for example, having high response and low irregular torque. The shaft rotational position of the servo motor 124 is detected by an encoder (not shown), and then feedback control of the servo motor 124 is conducted based on this detected shaft rotational position.

The upper die mechanism 118 further has the slider 132 pivoted with the bottom end of the connecting rod 130, a guide (not shown) guiding the slider 132 in the vertical direction, the first linear sensor 136 detecting the position of the slider 132 to supply a signal to the control part 116, and the upper die 138 provided at the lower face of the slider 132.

The steel sheet 112 is placed between the upper die 138 and the lower die 152 for conducting press-forming. The upper die 138 is provided with the die face 138*a* at the lower face for abutting the upper face of the steel sheet 112. In addition, the ring-like holder 140 projects to some extent around the upper die 138. Therefore, the holder 140 abuts the steel sheet 112 before the die face 138*a*. The top end face of the holder 140 is set to the horizontal.

The lower die mechanism 120 has the fixed base 150 to be a base, the lower die 152 provided at the upper part of the fixed base 150, the ring-like blank holder 154 supporting the peripheral part of the steel sheet 112, and the die cushion mechanism 156 lifting and lowering the blank holder 154.

The steel sheet 112 is placed between the lower die 152 and the upper die 138 for conducting press-forming. The lower die 152 is provided with the die face 152*a* at upper face for abutting the lower face of the steel sheet 112. This die face 152*a* is formed in a shape corresponding to the die face 138*a* of the upper die 138.

The blank holder 154 is provided at the position opposed to the holder 140. The end part of the steel sheet 112 is held between the blank holder 154 and the holder 140 in order to prevent wrinkle generation, displacement, and the like when the steel sheet 112 is pressed.

The die cushion mechanism 156 has a holder support part (not shown) supporting the blank holder 154 and a hydraulic lifting and lowering mechanism (not shown) to lifting and lowering the holder support part. The die cushion mechanism 156 further has a servo motor (not shown) driving the lifting and lowering mechanism and a second linear sensor (now shown) detecting the position of a holder support part to supply a signal to the control part 116. In addition, the servo motor of this die cushion mechanism 156 is connected with the control part 116, so that the holder 140 and the blank holder 154 can press the peripheral part of the steel sheet 112 to be folded at an appropriate pressure while the predetermined pressure control is conducted.

The control part 116 drives the servo motor 124 while referring to a signal supplied from the encoder connected with the servo motor 124 and the first linear sensor 136, thereby sliding the slider 132 upward and downward. In addition, the control part 116 drives the servo motor of the die cushion mechanism 156 while referring to a signal supplied from the second linear sensor of the die cushion mechanism 156, thereby lifting and lowering the blank holder 154.

Figure 2:
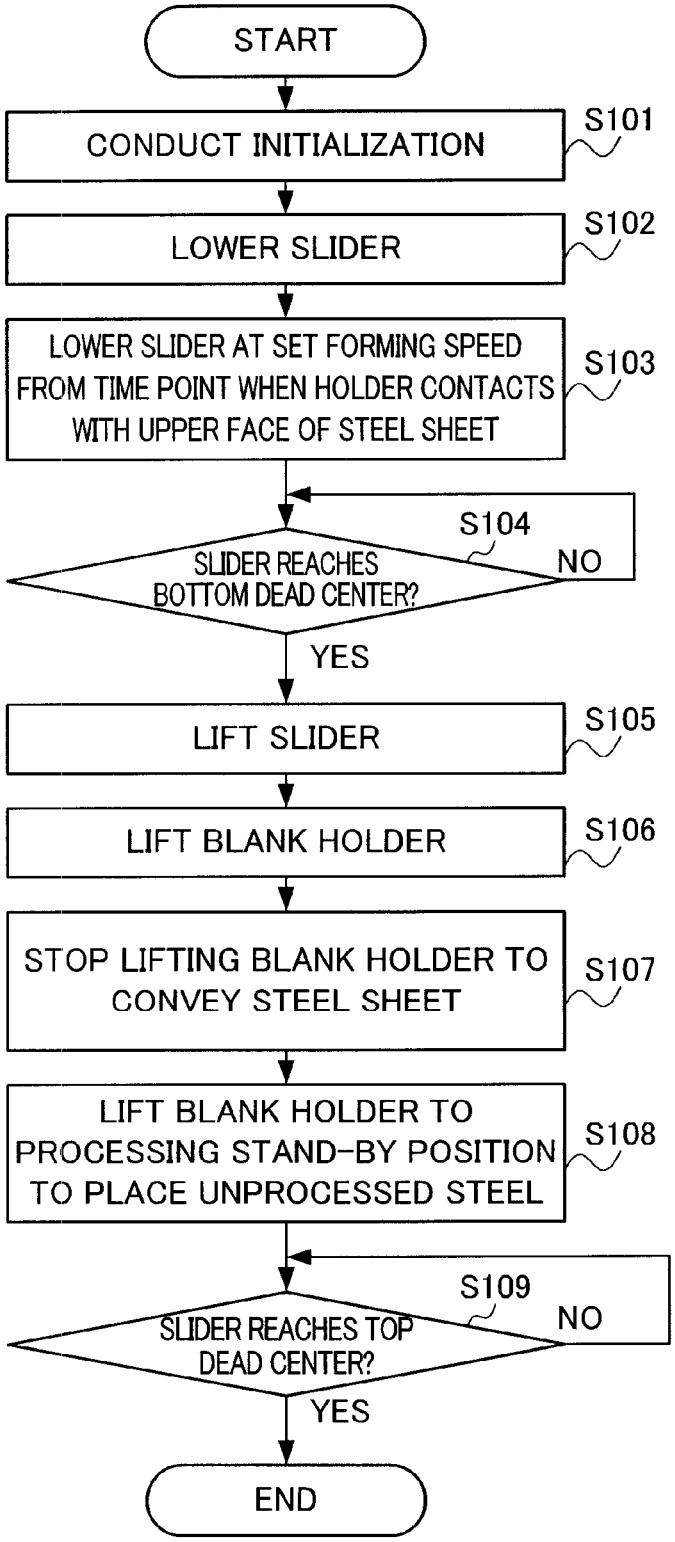
FIG. 2 is a flow chart illustrating the steps of the pressing method by a pressing machine according to the embodiment.

The method for processing the steel sheet 112 as a work by using the pressing machine 110 configured in the above-mentioned way is described below with reference to FIG. 2.

First, initialization is conducted in the step S101. That is, the blank holder 154 is lifted to the predetermined position to support the unprocessed steel sheet 112. Meanwhile, the slider 132 is lifted to the top dead center (for example, refer to the displacement $X_1$ of FIG. 9).

In the step S102, the servo motor 124 is rotarily driven to lower the slider 132, under action of the control part 116.

Figure 9:
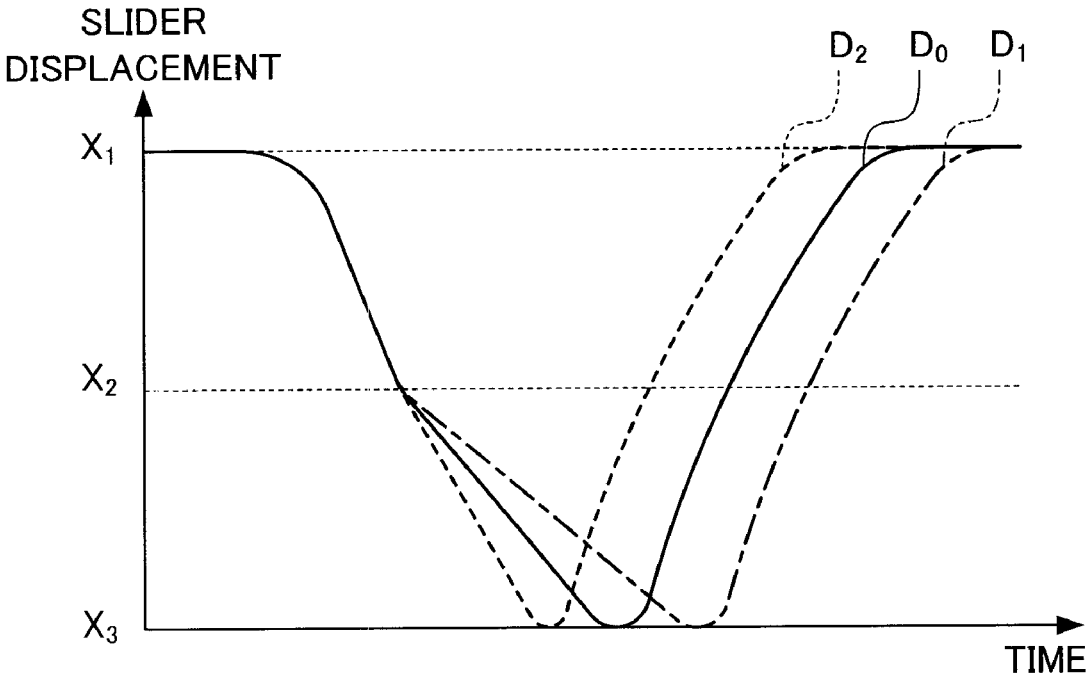
FIG. 9 is a graphic chart illustrating the slider displacement in one cycle of a pressing machine according to the embodiment.

When lowering the slider 132 to some extent, the holder 140 contacts with the upper face of the steel sheet 112, and then the steel sheet 112 is held between the holder 140 and the blank holder 154 (for example, refer to the displacement $X_2$ of FIG. 9). From this time point, the control part 116 lowers the slider 132 along with the blank holder 154 at the forming speed predefined by the below-mentioned forming speed determination method (Step S103).

At this point, the control part 116 generates moderate force so that the black holder 154 presses the lower face of the steel sheet 112 in some degree to conduct pressure control to lower the steel sheet 112 to be maintained firmly. That is, the blank holder 154 is pressed by the holder 140 through the steel sheet 112, thereby applying moderate pressure to the steel sheet 112 to be depressed. As a result, the steel sheet 112 is lowered with the peripheral part held at the set forming speed by the holder 140 and the blank holder 154, and then gradually pressed into a product shape by the upper die 138 and the lower die 152.

In the step S104, the control part 116 checks whether or not the position of the slider 132 reaches the bottom dead center (for example, refer to the displacement $X_3$ of FIG. 9) while referring to a signal from the first linear sensor 136. If the slider 132 reaches the bottom dead center, the process proceeds to the step S105. Otherwise the slider 132 continues to be lowered.

In the step S105, the servo motor 124 is rotarily driven to lift the slider 132, under action of the control part 116. In the step S106, the blank holder 154 is lifted to the panel conveyance position under action of the control part 116.

In the step S107, the pressed steel sheet 112 placed on the blank holder 154 is conveyed to the station of the next step by the predetermined conveyance means.

In the step S108, the control part 116 lifts the blank holder 154 again to bring the blank holder 154 to reach the processing stand-by position and then place the processed steel sheet 112 on the predetermined position. In this period, the slider 132 continues to be lifted.

In the step S109, the control part 116 checks whether or not the position of the slider 132 reaches the top dead center (for example, refer to the displacement $X_1$ of FIG. 9) while referring to a signal from the first linear sensor 136. If the slider 132 unreaches the top dead center, the slider 132 continues to be lifted. Otherwise the processing of the steel sheet 112 ends.

In the above-mentioned pressing machine 110, the stain state of a steel sheet varies in accordance with the measurement point when a steel sheet (sheet material) is press-formed. Thus, the stain distribution diagram is used, in which the stain state at each measurement point of a steel sheet is presented as a point on the forming limit diagram of a steel sheet.

Figure 3:
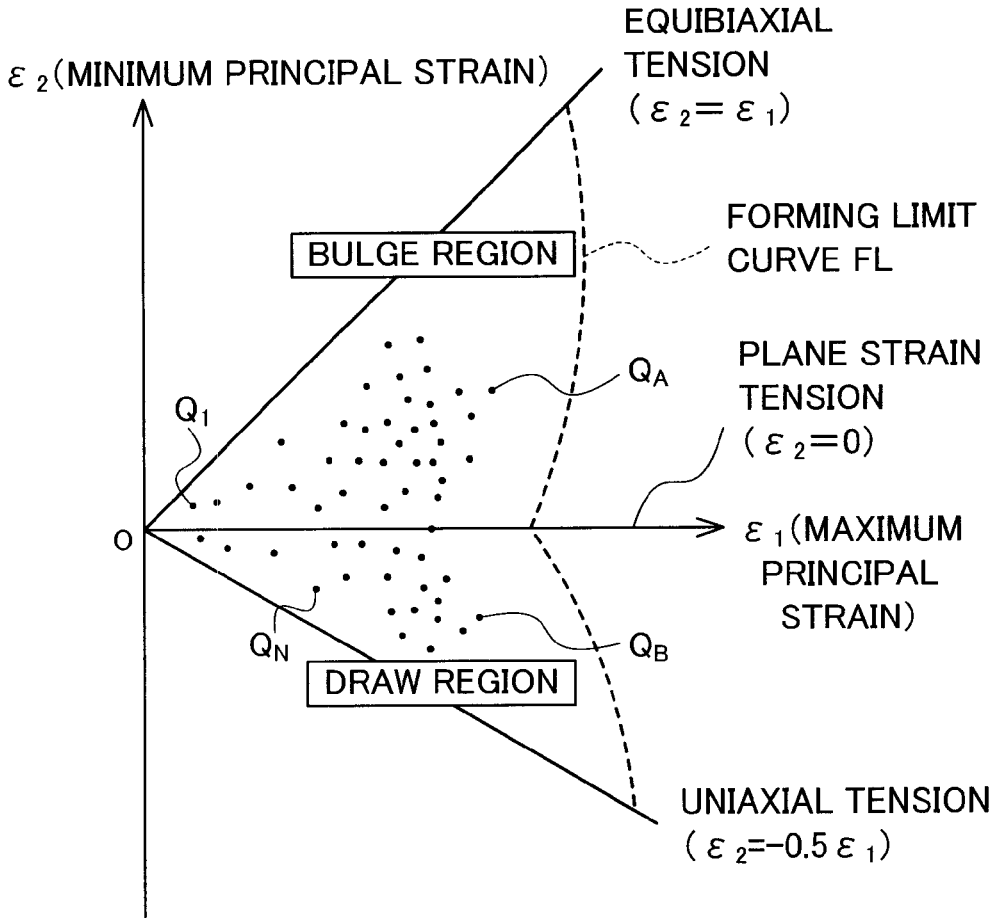
FIG. 3 is a stain distribution chart in which the stain state of a formed article is presented on the forming limit diagram of a steel sheet according to the embodiment.

FIG. 3 is a stain distribution chart in which the stain state of a formed article is presented on the forming limit diagram of a steel sheet. Specifically, FIG. 3 is a diagram in which the horizontal axis is defined a the maximum main strain $\epsilon_1(\geqq 0)$ in the in-plane direction of a steel sheet, and the vertical axis is defined as the minimum main strain $\epsilon_2$ in the in-plane direction of a steel sheet, and the stain states (deformation states) at respective measurement point on a press-formed article are plotted on this $\epsilon_1$-$\epsilon_2$ coordinate.

In the stain distribution diagram of this FIG. 3, the line ($\epsilon_2=\epsilon_1$) extending from the origin O to the upper right represents equibiaxial tension. This equibiaxial tension ($\epsilon_2=\epsilon_1$) brings a steel sheet to extend into an approximate similar shape to that before forming. For example, this equibiaxial tension corresponds to the deformation state of the bottom part of a deep-drawing container.

The line ($\epsilon_2=0$) extending from the origin O to the right represents plane strain tension. This plane strain tension ($\epsilon_2=0$) brings a steel sheet to have an invariable size in the width direction (direction along $\epsilon_2$) and extend along the height direction (direction along $\epsilon_1$). For example, this plane strain tension corresponds to the bend section of a wide steel sheet and the deformation state at the vicinity of the shoulder-sidewall part boundary of a deep-drawing container.

The line ($\epsilon_2=-0.5\epsilon_1$) extending from the origin O to the lower right represents uniaxial tension. This uniaxial tension ($\epsilon_2=-0.5\epsilon_1$) brings a steel sheet to be drawn along the width direction (direction along $\epsilon_2$) and extend along the height direction (direction along $\epsilon_1$). That is, the uniaxial tension corresponds to the deformation state in which a steel sheet is extended uniaxially.

In addition, the dashed line in FIG. 3 represents the forming limit curve FL of a steel sheet. This forming limit curve FL is produced by plotting the breaking strain in $\epsilon_1$-$\epsilon_2$ coordinate, in which the breaking strain is measured by changing the strain ratio $\epsilon_2/\epsilon_1$ in the sheet face. The forming limit curve FL depends on the material, the sheet thickness, and the like of a steel sheet. That is, the forming limit curve FL illustrates in what way the forming limit varies by the forming method of a steel sheet. Furthermore, on the $\epsilon_1$-$\epsilon_2$ coordinate, the region of $\epsilon_2>0$ represents the bulge region in which a steel sheet is bulge-formed, and the region of $\epsilon_2\leqq 0$ represents the draw region in which a steel sheet is draw-formed.

Figure 4:
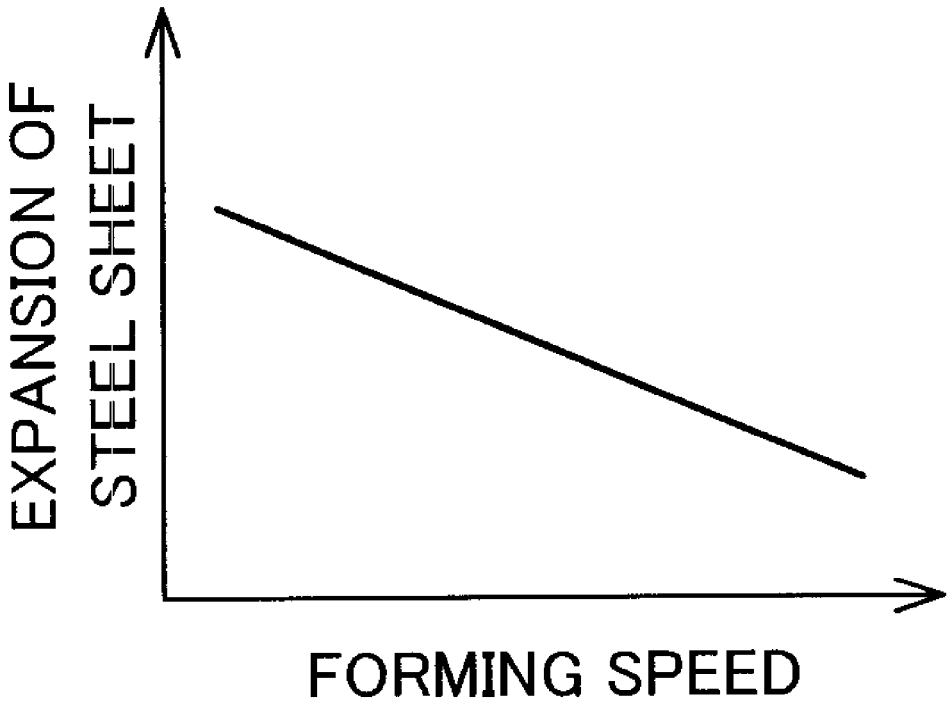
FIG. 4 is a graphic chart illustrating the relationship between the forming speed of a pressing machine and the expansion of a steel sheet according to the embodiment.

The relationship between the above-mentioned forming method in the pressing machine 110 and the forming speed is described below with reference to FIGS. 4-6. FIG. 4 is a graphic chart illustrating the relationship between the forming speed of the pressing machine 110 and the expansion of a press-formed steel sheet. As shown in FIG. 4, the expansion of a steel sheet decreases as the forming speed increases. Accordingly, in the case of the bulge-forming in which the expansion of a steel sheet has a major impact on the forming limit, the sheet thickness decrease rate of a formed part decreases as the forming speed decreases, so that it is preferable that the forming speed of the pressing machine 110 is decreased.

Figure 5:
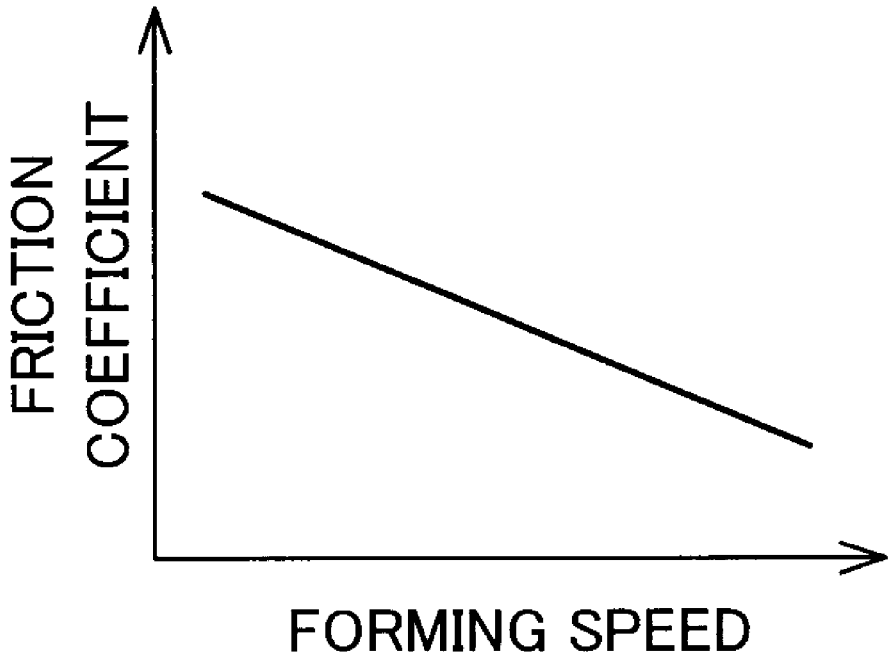
FIG. 5 is a graphic chart illustrating the relationship between the forming speed of a pressing machine and the friction coefficient of a steel sheet with a die according to the embodiment.
Figure 6:
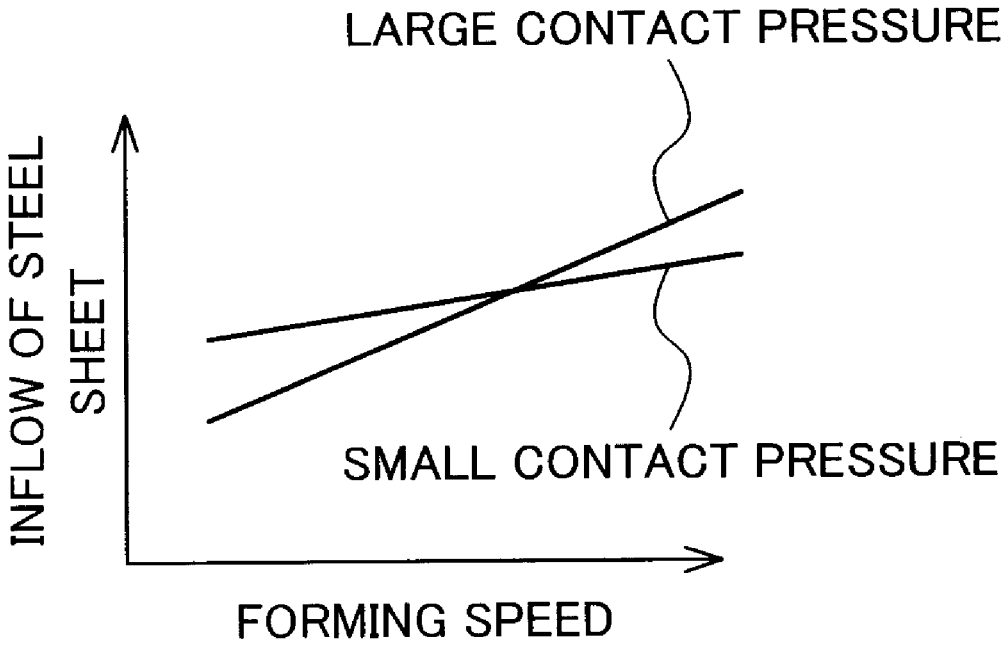
FIG. 6 is a graphic chart illustrating the relationship between the forming speed of a pressing machine and the inflow of a steel sheet according to the embodiment.

FIG. 5 is a graphic chart illustrating the relationship between the forming speed of the pressing machine 110 and the friction coefficient of a steel sheet with a die. FIG. 6 is a graphic chart illustrating the relationship between the forming speed of the pressing machine 110 and the inflow of a steel sheet. As shown in FIG. 5, the friction coefficient between a steel sheet and the die of the pressing machine 110 decreases as the forming speed of the pressing machine 110 increases. Thus, as shown in FIG. 6, the inflow of a steel sheet increases as the forming speed increases. Accordingly, in the case of the draw-forming in which the inflow of a steel sheet has a major impact on the forming limit, the sheet thickness decrease rate of a formed part decreases as the forming speed increases, so that it is preferable that the forming speed of the pressing machine 110 is increased. In addition, the frictional impact increases as the contact pressure increases, so that the inflow of a steel sheet more significantly increases when the contact pressure is large than when it is small, as shown in FIG. 6.

Figure 7:
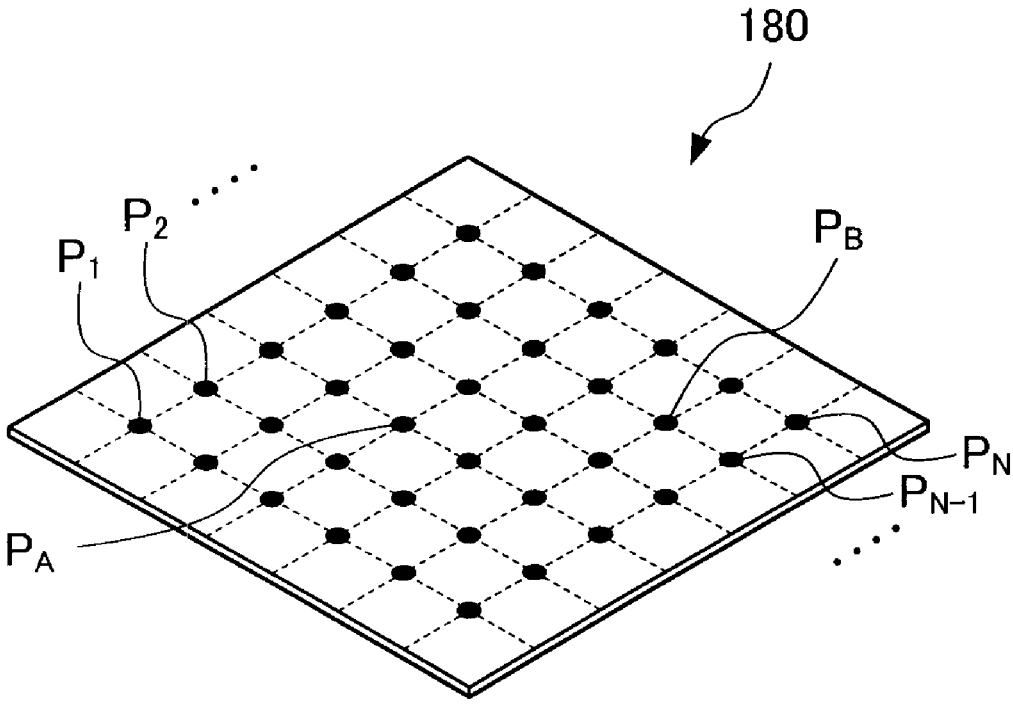
FIG. 7 is a perspective view illustrating a steel sheet before press-forming according to the embodiment.
Figure 8:
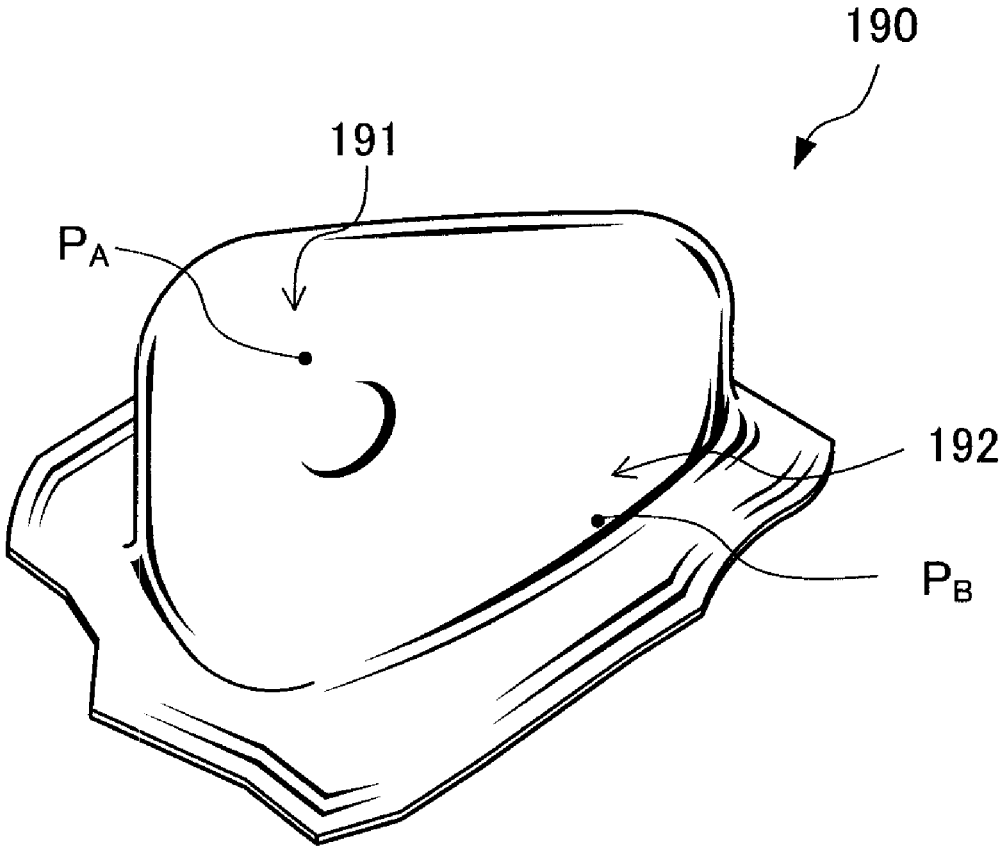
FIG. 8 is a perspective view illustrating a fuel tank of a motorcycle formed by conducting press-forming of a steel sheet according to the embodiment.

The steps of determining the forming speed in the above-mentioned pressing machine 110 is described below with reference to FIGS. 7-9. FIG. 7 is a perspective view illustrating the steel sheet 180 before press-forming. FIG. 8 is a perspective view illustrating a fuel tank 190 of a motorcycle formed by conducting press-forming of this steel sheet 180 with the pressing machine 110. FIG. 9 is a diagram illustrating the displacement of the slider 132 in one cycle of the pressing machine 110. The method for determining a forming speed of the pressing machine 110 is described below as one example of the case in which the fuel tank 190 of a motorcycle as shown in FIG. 8 is press-formed.

The forming speed determination method for determining a forming speed of the pressing machine 110 is configured by including the three steps of a test press-forming step, a strain distribution chart plotting step, and a forming speed determination step.

In the test press-forming step, the pressing machine 110 conducts press-forming of the steel sheet 180 on which measurement points are provided, at the predetermined forming speed. Specifically, a plurality of the measurement points $P_1$-$P_N$ are provide in a mesh shape on the steel sheet 180 first as shown in FIG. 7, which are defined as test pieces for determining the forming speed of the pressing machine 110. Then, the above-mentioned pressing machine 110 conducts press-forming of this steel sheet 180 to form the fuel tank 190 of a motorcycle as shown in FIG. 8. The fuel tank 190 formed in this way has an approximate box shape as shown in FIG. 8, which includes both of the bulge-formed part 191 and the draw-formed part 192.

At this point, in this test press-forming step, the slider 132 is controlled at the speed, for example, represented by the continuous line $D_0$ in FIG. 9 in order to conduct press-forming. Thus, the above-mentioned predetermined forming speed is the interval speed of the slider 132 reaching from the displacement $X_2$ (the position at which the die face 138*a* of the upper die 138 contacts with the steel sheet 112) to the displacement $X_3$ (bottom dead center) as shown in FIG. 9, which is determined as a test forming speed.

In the strain distribution chart plotting step, strains at the respective measurement points $P_1$-$P_N$ on the steel sheet 180 press-formed in the test press-forming step is measured, and then the measured strain is plotted on the forming limit diagram of the steel sheet 180 to produce a stain distribution diagram. Specifically, stain states at respective measurement points $P_1$-$P_N$ on the fuel tank 190, which is $\epsilon_1$ and $\epsilon_2$, are measured and then plotted on the forming limit diagram on which the forming limit curve FL of the steel sheet 180 is provided, in order to produce a stain distribution diagram shown in FIG. 3. The points $Q_1$-$Q_N$ in FIG. 3 represent stain states at the respective measurement points $P_1$-$P_N$ on the steel sheet 180.

In the forming speed determination step, the forming speed is determined by adjusting the test forming speed set in the above-mentioned test press-forming step based on the stain distribution diagram produced in the strain distribution chart plotting step. Specifically, the closest point to the forming limit curve FL, which belongs to the bulge region ($\epsilon_2>0$), is first specified among points $Q_1$-$Q_N$ on the stain distribution diagram. Then, the closest point to the forming limit curve FL, which belongs to the draw region ($\epsilon_2 \leqq 0$), is specified among the points $Q_1$-$Q_N$ on the stain distribution diagram. According to the example of the stain distribution diagram shown in FIG. 3, the points $Q_A$ and $Q_B$ are specified as the closest points to the forming limit curve FL. At this point, the points $Q_A$ and $Q_B$ on the stain distribution diagram correspond to the stain states at the respective measurement points $P_A$ and $P_B$ of FIG. 8.

Then, the closest point to the forming limit curve FL between the points $Q_A$ and $Q_B$ is defined as a specific measurement point. According to the example of the stain distribution diagram shown in FIG. 3, the point $Q_A$ is closer to the forming limit curve FL than the point $Q_B$, and thus the point $Q_A$ is defined as a specific measurement point. Therefore, the point $Q_A$ defined a specific measurement point is the closest to the forming limit curve FL of the steel sheet 180, so that it can be said that the measurement point $P_A$ corresponding to this point $Q_A$ on the formed fuel tank 190 is the most attentive position in order to improve the quality of the formed article.

Accordingly, in the example shown in FIG. 3, the measurement point A belongs to the bulge region ($\epsilon_2>0$) on the stain distribution diagram, so that it can be said that bulge-forming is predominant in the fuel tank 190. Therefore, in the fuel tank 190 in which the bulge-forming is predominant, it is desired that the forming speed is adjusted smoothly so as to conduct bulge-forming.

Then, in the stain distribution diagram, When the specific measurement point is located in the bulge region ($\epsilon_{2>0}$), the forming speed of the pressing machine 110 is decreased to be slower than the above-mentioned test forming speed. Meanwhile, When the specific measurement point is located in the draw region ($\epsilon_2 \leqq 0$), the forming speed of the pressing machine 110 is increased to be faster than the test forming speed.

Specifically, When the specific measurement point is located in the bulge region ($\epsilon_2>0$), the forming speed of the pressing machine 110 is set to be slower than the test forming speed as shown in the dashed line $D_1$ in FIG. 9 in order to conduct bulge-forming which is predominant in the fuel tank 190 smoothly. Meanwhile, When the specific measurement point is located in the draw region ($\epsilon_2 \leqq 0$), the forming speed of the pressing machine 110 is set to be faster than the test forming speed as shown in the dashed line $D_2$ in FIG. 9 in order to conduct draw-forming which is predominant in the fuel tank 190 smoothly.

According to the example of the stain distribution diagram shown in FIG. 3, the measurement point A (specific measurement point) is located in the bulge region ($\epsilon_2>0$), and thus the forming speed is set to be slower than the test forming speed (continuous line $D_0$), as shown in dashed line $D_1$ in FIG. 9.

According to the present embodiment, the following effect is attained.

(1) Among strain states $Q_1$-$Q_N$ in the respective measurement points $P_1$-$P_N$ on the press-formed steel sheet 180, the closest strain state to the forming limit curve FL of this steel sheet 180 is defined as a specific measurement point. When the specific measurement point belongs to the bulge region ($\epsilon_2>0$), it is assumed that the bulge-forming is predominant in this formed article (fuel tank 190), and thus the forming speed is decreased. Meanwhile, when the specific measurement point belongs to the draw region ($\epsilon_2\leqq 0$), it is assumed that draw-forming is predominant in this formed article, and thus the forming speed is increased. That is, the forming speed is decreased or increased in accordance with whether the specific measurement point belongs to the bulge region or the draw region. Therefore, the forming speed of the pressing machine 110 can be determined appropriately and promptly in accordance with the material of the steel sheet 180 and the shape of a formed article, compared with the case to determine the forming speed based on intuition and experience of an operator in a conventional way.

Second Embodiment

Figure 10:
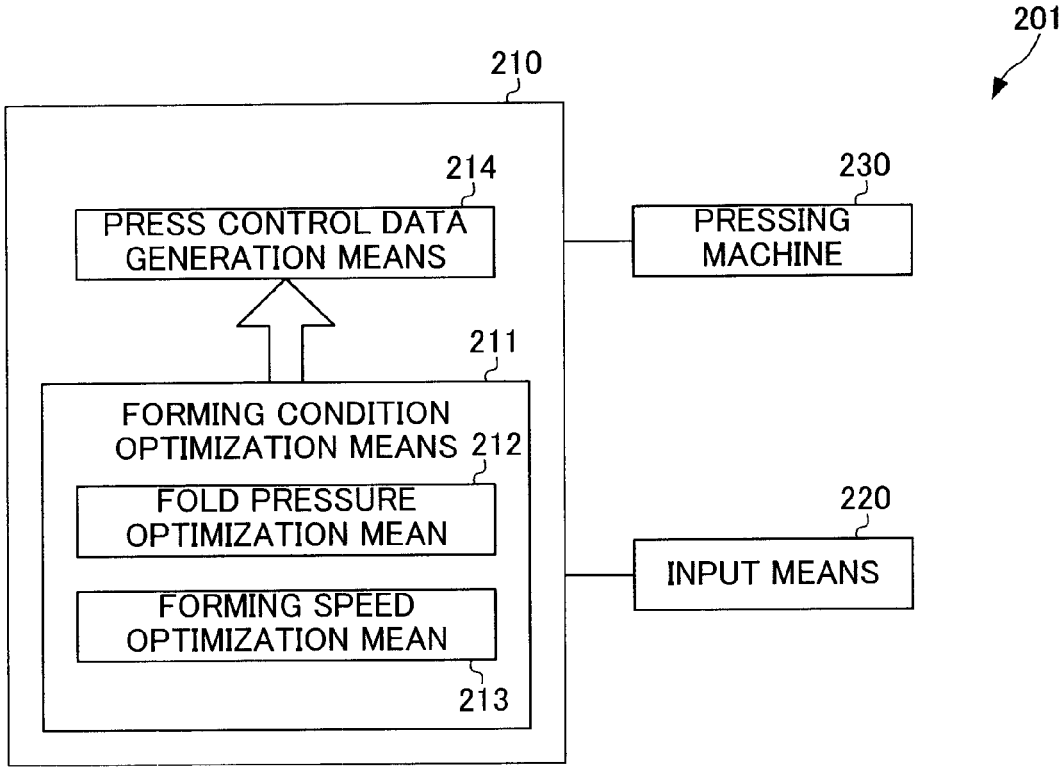
FIG. 10 is a schematic configuration diagram of the forming condition determination system according to the second embodiment of the present invention.

FIG. 10 is a schematic configuration diagram of the forming condition determination system 201 according to the second embodiment of the present invention. The forming condition determination system 201 is connected with the pressing machine 230, which is provided with the operation processing device 210 executing various programs and the input means 220 for inputting information to the operation processing device 21C. The pressing machine 230 is a servo pressing machine driven with a servo. The forming condition determination system 201 outputs the pressing condition including the forming speed and the fold pressure to this pressing machine 230.

The forming condition determination system 201 is provided with the forming condition optimization means 211 and the press control data generation means 214 as programs developed on OS (Operating System) conducting operation control.

The forming condition optimization means 211 is provided with the fold pressure optimization means 212 and the forming speed optimization means 213, which optimizes the fold pressure and the forming speed included in the above-mentioned pressing condition. Specifically, the fold pressure optimization means 212 and the forming speed optimization means 213 conduct a forming simulation (CAE analysis) based on information input from the input means 220 to determine the optimum fold pressure and the optimum forming speed based on the simulation, respectively.

The press control data generation means 214 generates data for operating the pressing machine 230 based on the forming conditions determined by the forming condition optimization means 211. The input means 220 is a keyboard capable of input necessary information in order to conduct forming simulation by forming condition optimization means 211.

Figure 11:
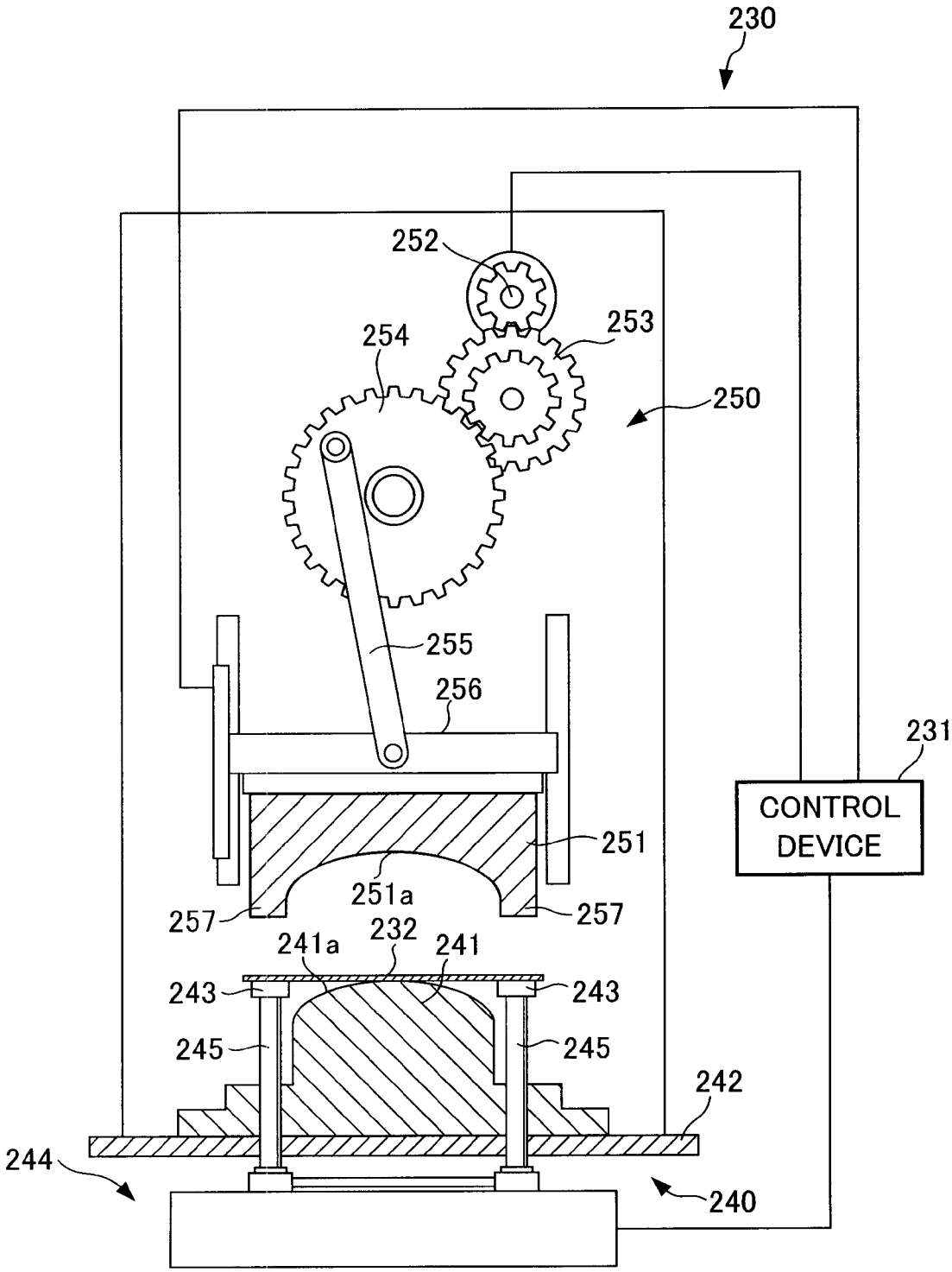
FIG. 11 is a schematic configuration diagram of a pressing machine of the forming condition determination system according to the embodiment of the present invention.

FIG. 11 is a diagram illustrating a schematic configuration of the pressing machine 230. The pressing machine 230 is a so-called servo pressing machine, which is provided with the lower die mechanism 240 having the lower die 241 placed at the lower side of the steel sheet 232 as a work, the upper die mechanism 250 bringing the upper die 251 to approach to and isolate from the lower die 241, and the control device 231 controlling the lower die mechanism 240 and the upper die mechanism 250.

The upper die mechanism 250 has the servo motor 252, the reduction gear 253 rotarily driven by the servo motor 252, the rotating plate 254 rotarily driven at large torque by the reduction gear 253, and the connecting rod 255, the top part of which is pivoted swingably with the side face of the rotating plate 254.

The servo motor 252 is of an AC type for example, having high response and low irregular torque. The shaft rotational position of the servo motor 252 is detected by an encoder (not shown), and then feedback control of the servo motor 252 is conducted based on this detected shaft rotational position.

The upper die mechanism 250 is further provided with the slider 256 pivoted to the bottom end of the connecting rod 255, in which the upper die 251 is provided at the lower face of the slider 256.

The steel sheet 232 is placed between the upper die 251 and the lower die 241 for conducting press-forming. The upper die 251 is provided with the die face 251*a* at the lower face for abutting the upper face of the steel sheet 232. This die face 251*a* has a concavo curve, and the ring-like holder 257 is provided around the upper die 251. The top end face of the holder 257 is the horizontal, which projects to some extent before the die face 251*a*. Therefore, the holder 257 abuts the steel sheet 232 before the form side 251*a*.

In addition to the lower die 241, the lower die mechanism 240 has the fixed base 242 to be a base, the ring-like blank holder 243 supporting the peripheral part of the steel sheet 232, and the die cushion mechanism 244 lifting and lowering the blank holder 243.

The lower die 241 is provided at the upper part of the fixed base 242, and the steel sheet 232 is placed between the lower die 241 and the upper die 251 for conducting press-processing. On the upper face of this lower die 241, the die face 241*a* is provided for contacting with the lower face of the steel sheet 232.

The blank holder 243 is provided at the position opposed to the holder 257. The end part of the steel sheet 232 is held between the blank holder 243 and the holder 257 in order to prevent wrinkle generation, displacement, and the like when the steel sheet 232 is pressed.

The die cushion mechanism 244 has a plurality of the pins 245 penetrating the fixed base 242 and the lower die 241 from the lower side to support the lower part of the blank holder 243, and a hydraulic lifting and lowering mechanism (not shown) lifting and lowering these pins 245.

The lifting and lowering mechanism is configured by including a hydraulic cylinder (not shown) connected with the pins 245 and a servo equipment (not shown) driving this hydraulic cylinder. This servo equipment is connected with the control device 231. The blank holder 243 and the holder 257 press the peripheral part of the steel sheet 232 to be folded at appropriate pressure (fold pressure) by conducting the predetermined pressure control based on a signal from the control device 231.

The control device 231 rotarily drives the servo motor 252 to advance the upper die 251 to the lower die 241 and retrieves the upper die 251 from the lower die 241, and drives the die cushion mechanism 244 to lift and lower the blank holder 243.

Figure 12:
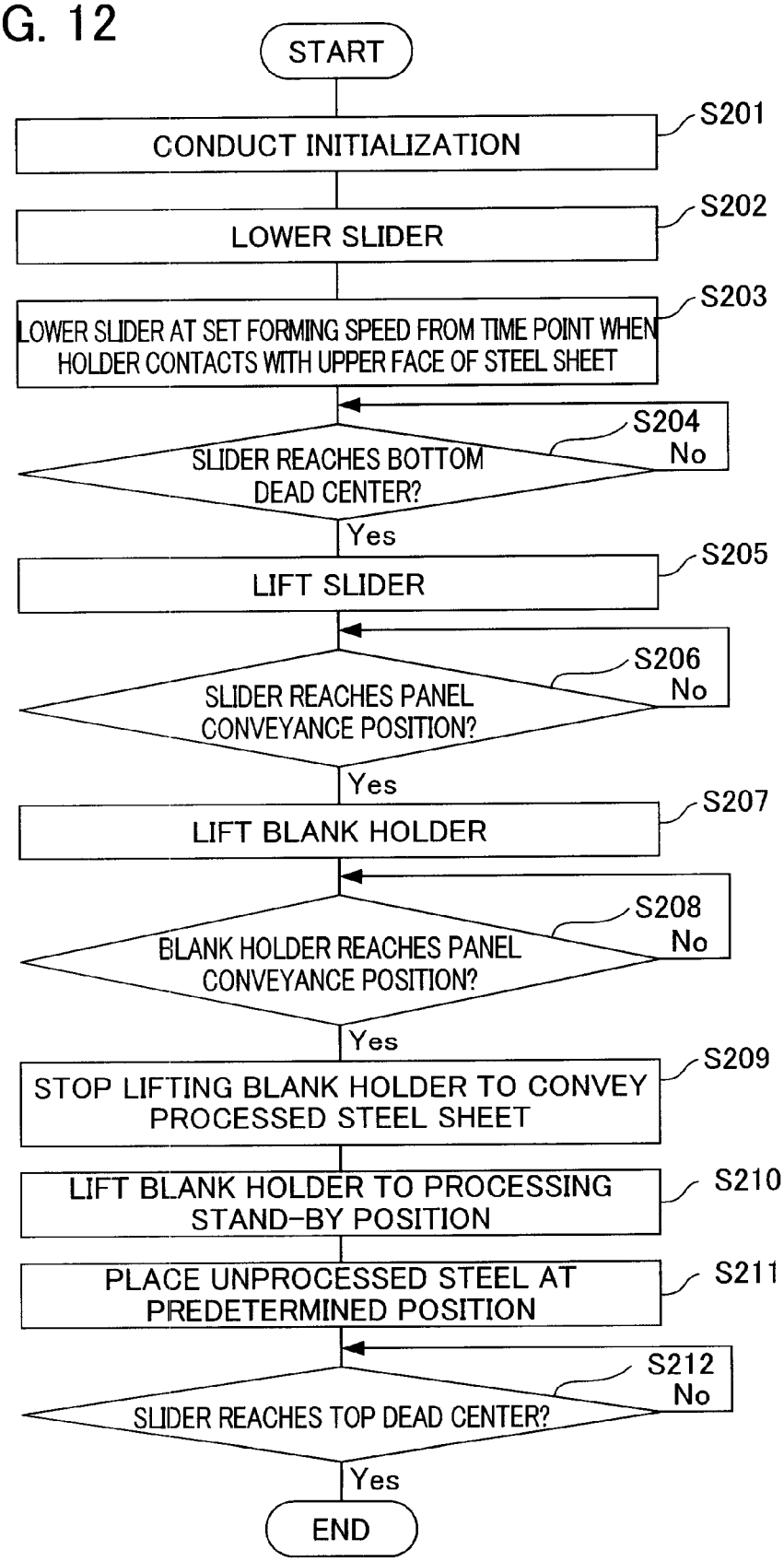
FIG. 12 is a flow chart illustrating the pressing steps of a pressing machine according to the embodiment.

The step of processing the steel sheet 232 by using the above-mentioned pressing machine 230 is described below with reference to FIG. 12.

First, initialization is conducted in the step S201. That is, the blank holder 243 is lifted to the predetermined position to support the unprocessed steel sheet 232. In addition, the upper die 251 lifts to the top dead center. In the step S202, the servo motor 252 is rotarily driven to lower the slider 256, under action of the control device 231.

When the slider 256 is lowered to some extent, the holder 257 contacts with the upper face of the steel sheet 232, and then the steel sheet 232 is held between the holder 257 and the blank holder 243. From this point, the blank holder 243 is lowered under action of the control device 231 (Step S203). Specifically, pressure control is conducted to lower the steel sheet 232 to be maintained firmly by generating moderate force so that the black holder 243 presses the lower face of the steel sheet 232 in some degree under action of the control device 231. That is, the blank holder 243 is pressed by the holder 257 through the steel sheet 232, thereby applying moderate pressure to the steel sheet 232 to be depressed. As a result, the steel sheet 232 is lowered with the peripheral part held (placed) by the holder 257 and the blank holder 243, and then gradually pressed into a product shape by the upper die 251 and the lower die 241.

In the step S204, the control device 231 brings the position of the slider 256 to reach the bottom dead center that is the most inferior point during one stroke of the upper die 251. In the step S205, the servo motor 252 is rotarily driven to lift the slider 256 to the panel conveyance position, under action of the control device 231.

In the step S206, it is checked whether or not the position of the slider 256 reaches the panel conveyance position. If the position of the slider 256 reaches the panel conveyance position, the process proceeds to the step S207. Otherwise the slider 256 continues to be lifted. In the step S207, the blank holder 243 is lifted under action of the control device 231. Thus, the blank holder 243 delays in some degree to be lifted after the slider 256.

In the step S208, the blank holder 243 is lifted to the panel conveyance position, under action of the control device 231. In the step S209, the lifting of the blank holder 243 is stopped temporarily to convey the draw-formed steel sheet 232 to the station of the next step by the conveyance means (not shown).

In the step S210, the control device 231 lifts the blank holder 243 again to bring the blank holder 243 to reach the processing stand-by position. In the step S211, an unprocessed steel sheet is placed to the predetermined position. In this period, the slider 256 continues to be lifted. In the step S212, the control device 231 brings the slider 256 to reach the top dead center.

Figure 13:
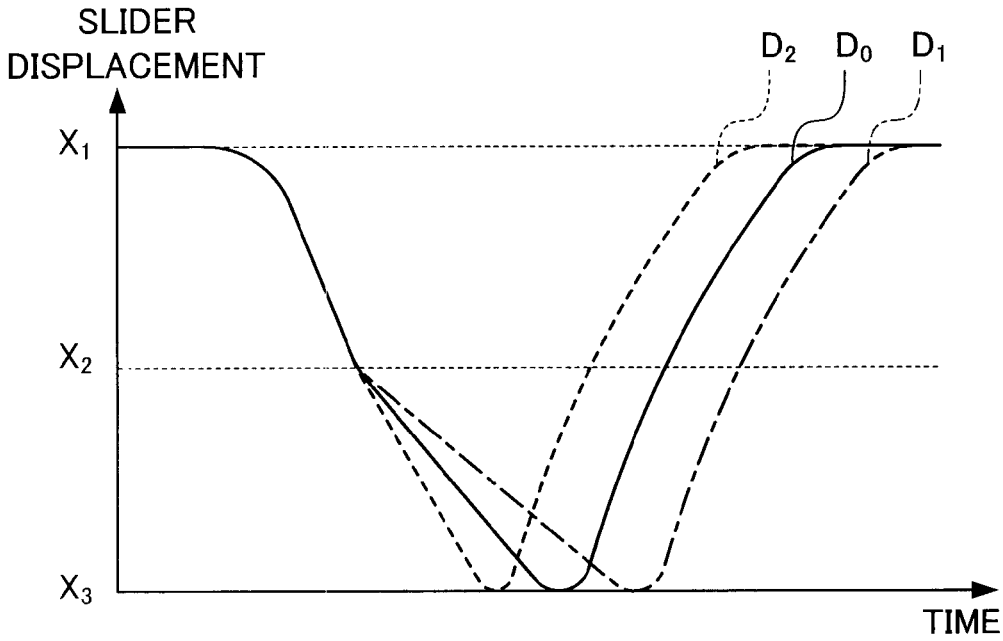
FIG. 13 is a diagram illustrating the relationship between the slider displacement and the forming time of a pressing machine according to the embodiment.

The slider displacement of the pressing machine 230 is described below with reference to FIG. 13. In the above-mentioned draw-forming, the slider 256, which is the upper die 251, is displaced as shown in FIG. 13 in order to conduct draw-processing. Specifically, the upper die 251 is lowered from the top dead center ($X_1$), and then the speed is decreased just before the position ($X_2$) at which the upper die 251 contacts with a steel sheet in order to conduct press-forming. When reaching the bottom dead center ($X_3$), the upper die 251 is lifted at the originally predetermined speed. Hereinafter, the forming speed is defined as the speed of the slider 256 during the interval while the slider 256 reaches from the contact position ($X_2$) to the bottom dead center ($X_3$) in FIG. 13.

Figure 14:
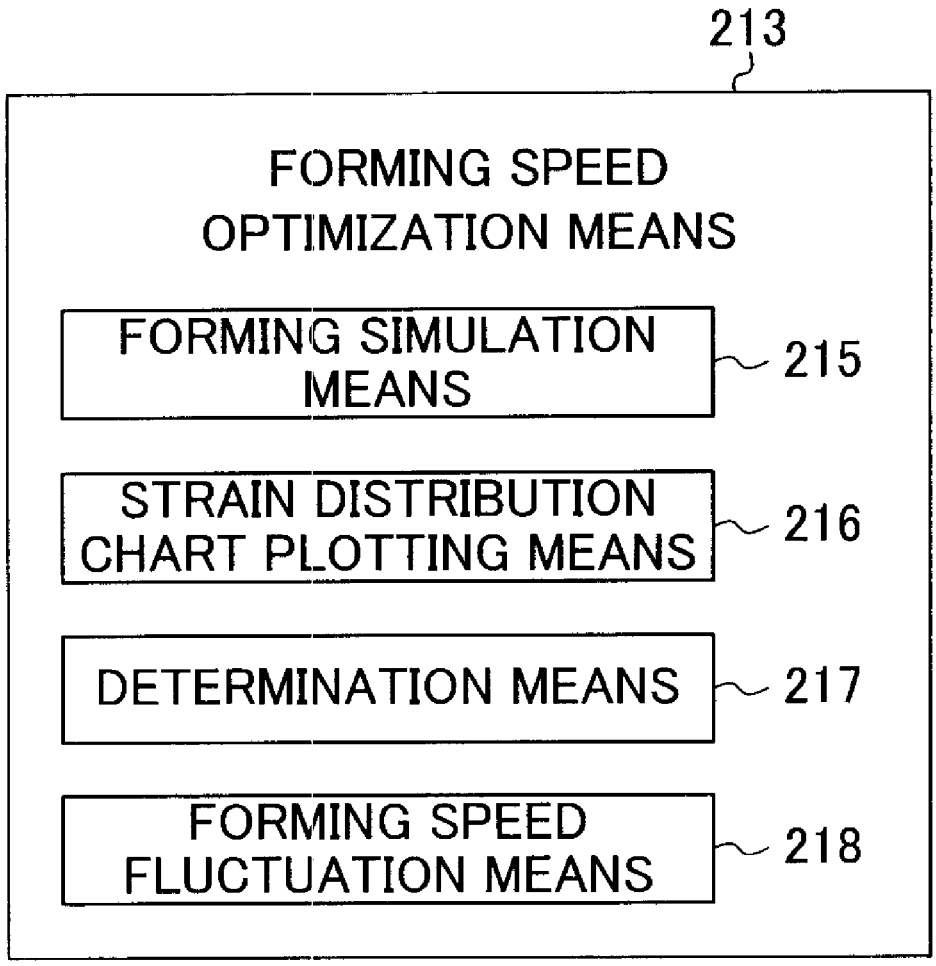
FIG. 14 is a block diagram of the forming condition optimization means of the forming condition determination system according to the embodiment.

FIG. 14 is a block diagram illustrating the schematic configuration of the forming speed optimization means 213. The forming speed optimization means 213 is provided with the forming simulation means 215 for conducting forming simulation, the strain distribution chart plotting means 216 for producing a strain distribution diagram, the determination means 217 for determining of the quality of a press-formed article, and the forming speed fluctuation means 218 for fluctuating setting of the forming speed.

The forming simulation means 215 conducts press-forming simulation. Specifically, when the analysis condition is input, the forming simulation means 215 conducts forming simulation under this analysis condition and then outputs the analysis result. In addition to the press-forming conditions including the forming speed and the fold pressure, this analysis condition includes the shape and the material of a work, the shape of a press-formed article, the boundary condition etc. necessary for forming simulation, and the like.

Figure 15:
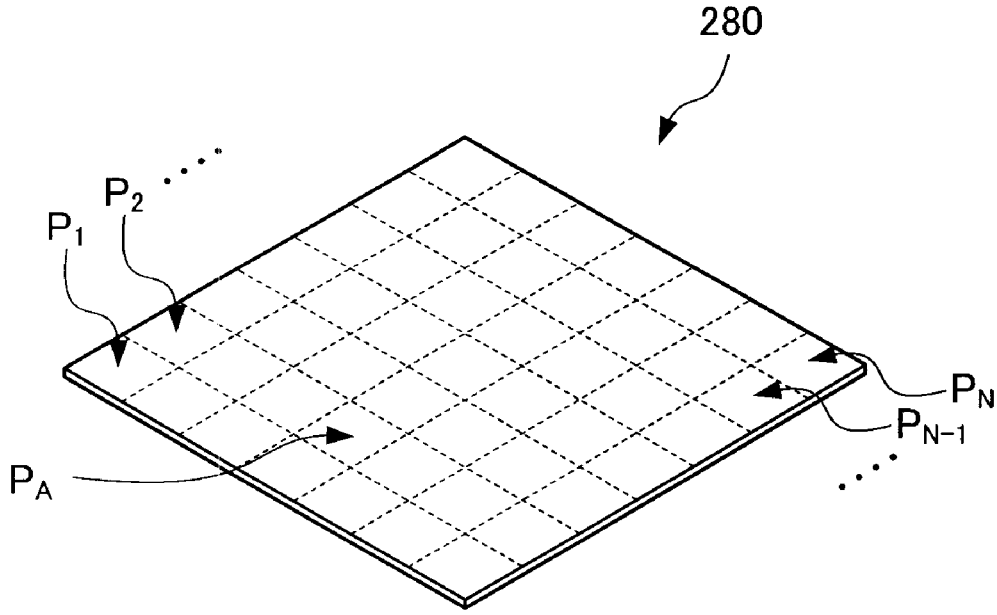
FIG. 15 is a perspective view illustrating one example of the work shape input as one of the analysis conditions of the forming simulation means according to the embodiment.
Figure 16:
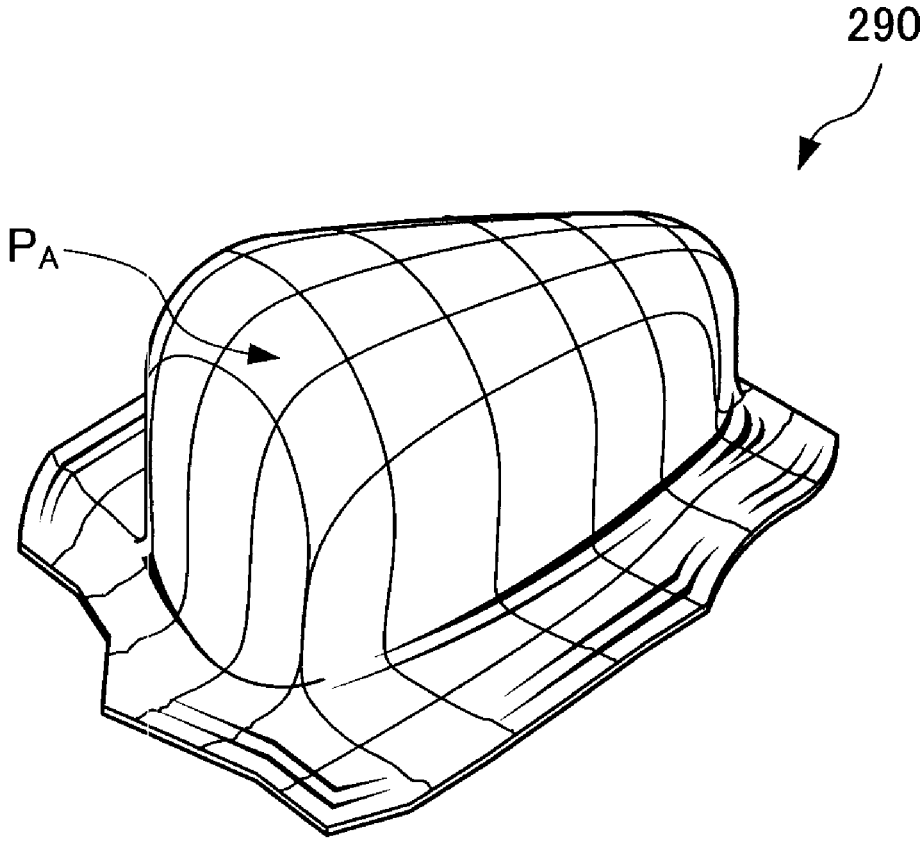
FIG. 16 is a diagram illustrating one example of the shape of a press-formed article input as one of the analysis conditions of the forming simulation means according to the embodiment.

FIG. 15 is a diagram illustrating one example of the work shape input as one of the analysis conditions. FIG. 16 is a diagram illustrating one example of the shape of a press-formed article input as one of the analysis conditions. In the forming simulation means 215 in the present embodiment, forming simulation is conducted. For example, forming simulation conducts press-forming of the work 280 with a sheet shape as shown in FIG. 15 to form the fuel tank 290 with an approximate box shape of a motorcycle shown in FIG. 16.

As shown in FIGS. 15 and 16, on the work 280 for which forming simulation is conducted, a plurality of the elements $P_1$-$P_N$ in a mesh shape is assumed in order to measure the state of a press-formed article. In addition, the analysis result of forming simulation includes the maximum principal strain and the minimum principal strain to be the index of wrinkles and surface strain of a press-formed article at the respective elements $P_1$-$P_N$.

The strain distribution chart plotting means 216 plots strain states at the respective elements $P_1$-$P_N$ of a press-formed work on a forming limit diagram including a forming limit curve based on the analysis result output from the forming simulation means 215, to produce a strain distribution diagram.

Figure 17:
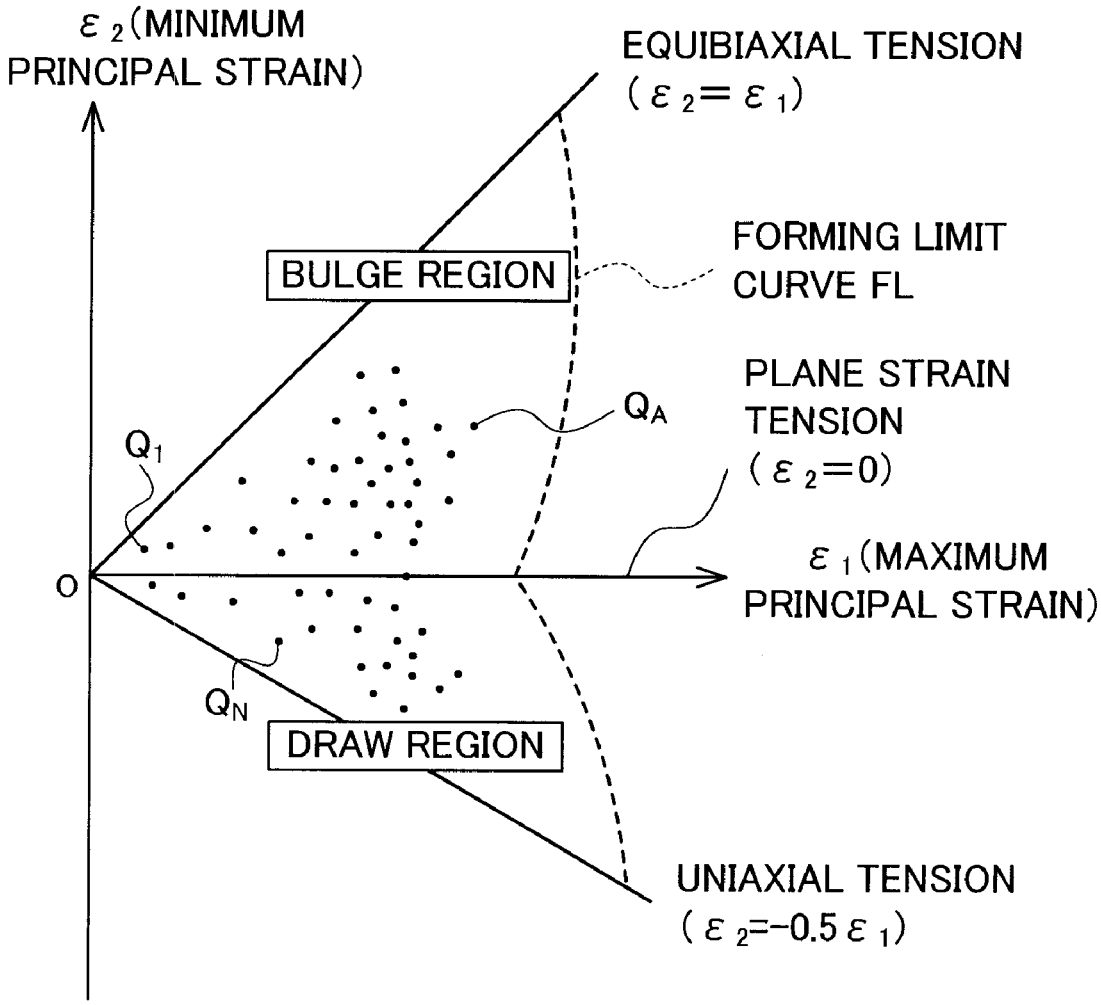
FIG. 17 is a diagram illustrating one example of the stain distribution chart in which the stain state of a press-formed article is presented on the forming limit diagram of a steel sheet according to the embodiment.
Figure 18:
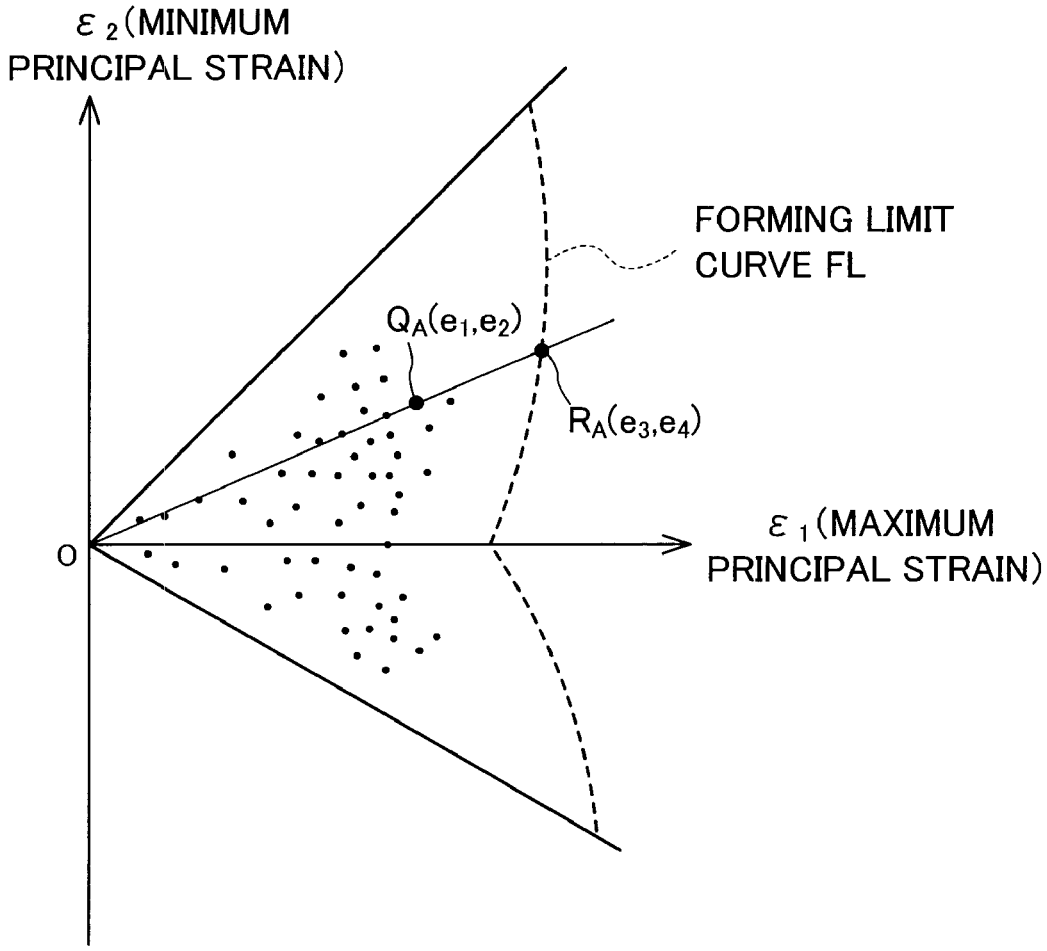
FIG. 18 is a diagram illustrating one example of the stain distribution chart in which the stain state of a press-formed article is presented on the forming limit diagram of a steel sheet according to the embodiment.

FIGS. 17 and 18 are diagrams illustrating one example of strain distribution diagrams produced by the strain distribution chart plotting means 216. Specifically, FIG. 17 is a diagram in which the horizontal axis is defined as the maximum main strain $\epsilon_1(\geqq 0)$ in the in-plane direction of a steel sheet, and the vertical axis is defined as the minimum main strain $\epsilon_2$ in the in-plane direction of a steel sheet, and the stain states (deformation states) at the respective elements $P_1$-$P_N$ on a press-formed article is plotted on this $\epsilon_1$-$\epsilon_2$ coordinate.

In the stain distribution diagram of this FIG. 17, the line ($\epsilon_2=\epsilon_1$) extending from the origin O to the upper right represents equibiaxial tension. This equibiaxial tension ($\epsilon_2=\epsilon_1$) brings a steel sheet to extend into an approximate similar shape to that before forming. For example, this equibiaxial tension corresponds to the deformation state of the bottom part of a deep-drawing container.

The line ($\epsilon_2=0$) extending from the origin O to the right represents plane strain tension. This plane strain tension ($\epsilon_2=0$) brings a steel sheet to have an invariable size in the width direction (direction along $\epsilon_2$) and extend along the height direction (direction along $\epsilon_1$). For example, this plane strain tension corresponds to the bend section of a wide steel sheet and the deformation state at the vicinity of a shoulder-sidewall part boundary of a deep-drawing container.

The line ($\epsilon_2=-0.5\epsilon_1$) extending from the origin O to the lower right represents uniaxial tension. This uniaxial tension ($\epsilon_2=-0.5\epsilon_1$) brings a steel sheet to be drawn along the width direction (direction along $\epsilon_2$) and extend along the height direction (direction along $\epsilon_1$). That is, the uniaxial tension corresponds to the deformation state in which a steel sheet is extended uniaxially.

In addition, the dashed line in FIG. 17 represents the forming limit curve FL. This forming limit curve FL is produced by plotting the breaking strain in $\epsilon_1$-$\epsilon_2$ coordinate, in which the breaking strain is measured by changing the strain ratio $\epsilon_2/\epsilon_1$ in the sheet face. The forming limit curve FL depends on the material, the sheet thickness, and the like of a work. Furthermore, on the $\epsilon_1$-$\epsilon_2$ coordinate, the region of $\epsilon_2>0$ represents the bulge region in which a work is bulge-formed, and the region of $\epsilon_2\leqq 0$ represents the draw-formed. The strain distribution chart plotting means 216 plots the strain states at the respective elements $P_1$-$P_N$ of a press-formed work on the above-mentioned forming limit diagram as the points $Q_1$-$Q_N$ to produce a strain distribution diagram shown in FIG. 17.

The determination means 217 determines whether or not the quality of a press-formed article satisfies a certain standard based on a strain distribution diagram produced by the strain distribution chart plotting means 216. Specifically, the determination means 217 extracts the most crackable point among the points $Q_1$-$Q_N$ plotted on the strain distribution diagram as the maximum crack risk point $Q_A$ to determine whether or not the quality of a press-formed article satisfies a certain standard based on the position of this maximum crack risk point $Q_A$.

The determination means 217 first calculates the degrees of crack risk $E_1$-$E_N$ at the respective points $Q_1$-$Q_N$ plotted in the strain distribution diagram. Specifically, the intersection point of a straight line passing over the start point and the target point Q with the forming limit curve is defined as R and then the degree of crack risk E is calculated by dividing the distance between the starting point and the intersection point R by the distance between the starting point and the target point Q.

For example, the degree of crack risk $E_A$ of the point $Q_A$ of the strain distribution diagrams shown in FIG. 18 is calculated by the following expression. In the expression, the values of the maximum principal strain and the minimum principal strain at the point $Q_A$ are defined as ($e_1$, $e_2$) respectively, and the values of the maximum principal strain and the minimum principal strain at the intersection point $R_A$ are defined as ($e_3$, $e_4$) respectively.

$$E_A = \frac{\sqrt{e_3^2 + e_4^2}}{\sqrt{e_1^2 + e_2^2}}$$

Accordingly, this degree of crack risk E is an index representing the risk of crack generation in a press-formed article, and thus the risk of crack generation increases as this degree of crack risk E decreases. It is estimated that the risk of crack generation is low when E>1, the risk of crack generation reaches the critical limit when E=1, and a crack is generated when E<1.

The determination means 217 calculates the degrees of crack risk $E_1$-$E_N$ at the respective points $Q_1$-$Q_N$ plotted on the strain distribution diagram, extracts the point having the smallest degree of crack risk among these degrees of crack risk $E_1$-$E_N$, and then defines the extracted point as a maximum crack risk point. In the example shown in FIG. 18, the point $Q_A$ is extracted as a maximum crack risk point.

In addition, the determination means 217 determines the quality of a formed article based on the degree of crack risk $E_A$ of the extracted maximum crack risk point $Q_A$. Specifically, the determination means 217 sets the predetermined value greater than 1 as a threshold in consideration of safety, and then determines the quality of a press-formed article satisfies a certain standard when the extracted degree of crack risk is greater than the threshold.

The forming speed fluctuation means 218 fluctuates the setting of the forming speed input to the above-mentioned forming simulation means 215 in accordance with the value of the minimum principal strain $e_2$ at the maximum crack risk point $Q_A$. Specifically, the forming speed fluctuation means 218 increases the forming speed to be set when the determination means 217 determines that the quality of a press-formed article unsatisfies a certain standard and when the value of the minimum principal strain $e_2$ at the maximum crack risk point $Q_A$ is 0 or less. Meanwhile, the forming speed fluctuation means 218 decreases the forming speed to be set when the determination means 217 determines that the quality of a press-formed article unsatisfies a certain standard and when the value of the minimum principal strain $e_2$ at the maximum crack risk point $Q_A$ is greater than 0.

The forming speed optimization means 213 configured as described above changes the setting of the forming speed input to the forming simulation means 215 and repeats the processing of the forming simulation means 215, the strain distribution chart plotting means 216, and the determination means 217 in order until the determination means 217 determines that the quality of a formed article satisfies a certain standard. At this point, when the determination means 217 determines that the quality of a formed article satisfies a certain standard, the forming speed is determined as the optimum forming speed.

Figure 19:
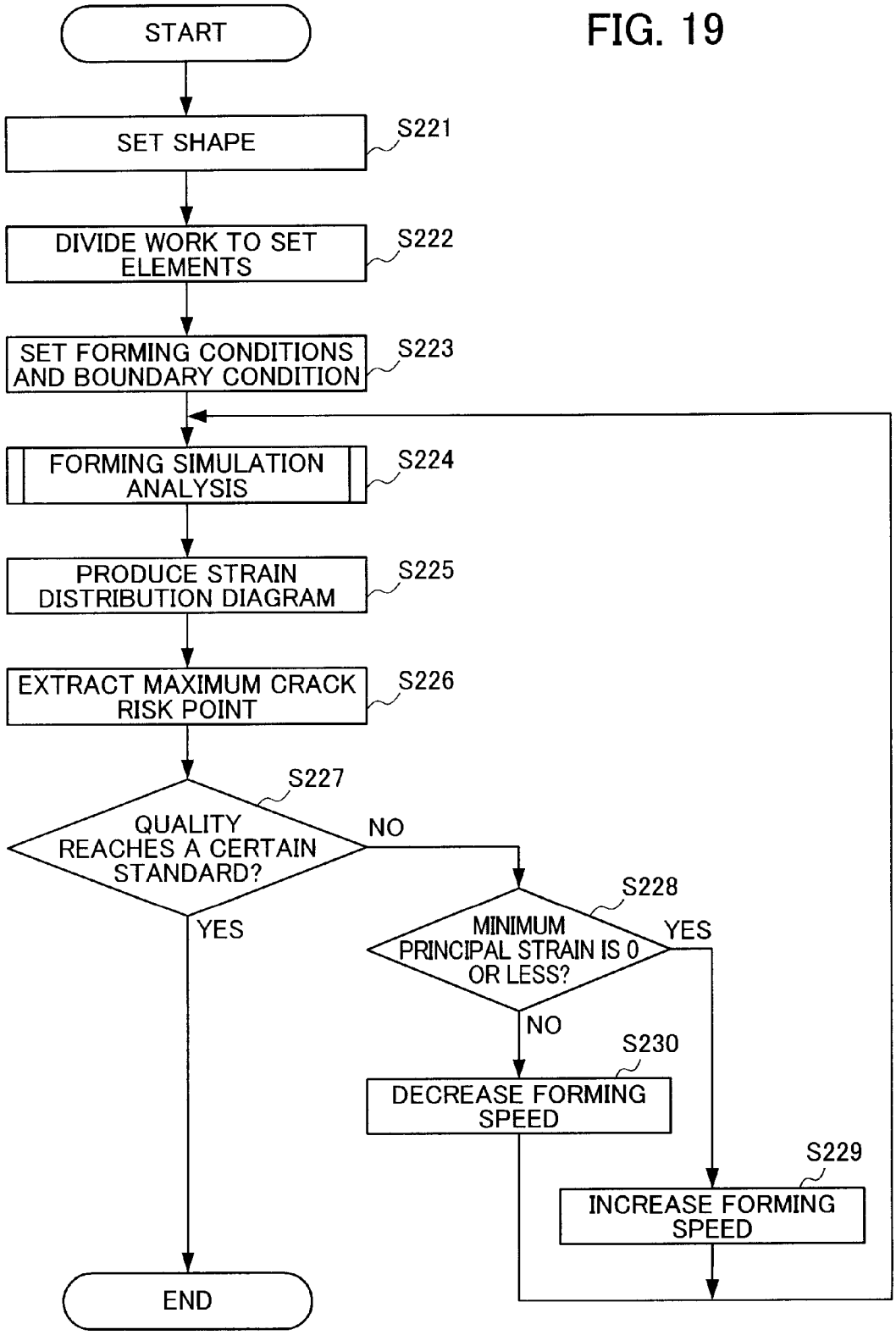
FIG. 19 is a flow chart illustrating operation of the forming speed optimization means according to the embodiment.

The operation of the forming speed optimization means 213 is described below by using the flow chart of FIG. 19. First, in the step S221, the shape of a press-formed article is set. In the step S222, a work is divided to set a plurality of elements. Specifically, in the present embodiment, the work 280 on which the elements $P_1$-$P_N$ shown in FIG. 15 are provided is set into the fuel tank 290 of a motorcycle as shown FIG. 16. In the step S223, in addition to the forming conditions including the forming speed and the fold pressure, the boundary condition necessary for forming simulation is set.

In the step S224, the forming simulation analysis described below with reference to FIGS. 23-31 is conducted under the analytical condition set in the above-mentioned steps S221-S223. In the step S225, the strain distribution diagram shown in FIG. 17 is produced based on the result of the forming simulation analysis. In the step S226, the maximum crack risk point $Q_A$ on the produced strain distribution diagram is extracted.

In the step S227, it is determined whether or not the quality of a press-formed article satisfies a certain standard based on the value of the degree of crack risk $E_A$ at the extracted maximum crack risk point $Q_A$. If this determination is "Yes", the set forming speed is determined as the optimum forming speed, and then the process ends. If this determination is "No", the process proceeds to the step S228.

In the step S228, it is determined whether or not the minimum principal strain at the maximum crack risk point $Q_A$ is 0 or less. If this determination is "Yes", the process proceeds to the step S229. If this determination is "No", the process proceeds to the step S230. In the step S229, the set forming speed is increased, the process proceeds to the step S224, and then the forming simulation analysis is reconducted. Specifically, in the case in which the set forming speed is the forming speed represented by the continuous line $D_0$ in FIG. 13, the set forming speed is increased to the forming speed represented by the dashed line $D_2$. In the step S230, the set forming speed is lowered, the process proceeds to the step S224, and then the forming simulation analysis is reconducted. Specifically, in the case in which the set forming speed is the forming speed represented by the continuous line $D_0$ in FIG. 13, the set forming speed is decreased to the forming speed represented by the dashed line $D_1$.

Figure 20:
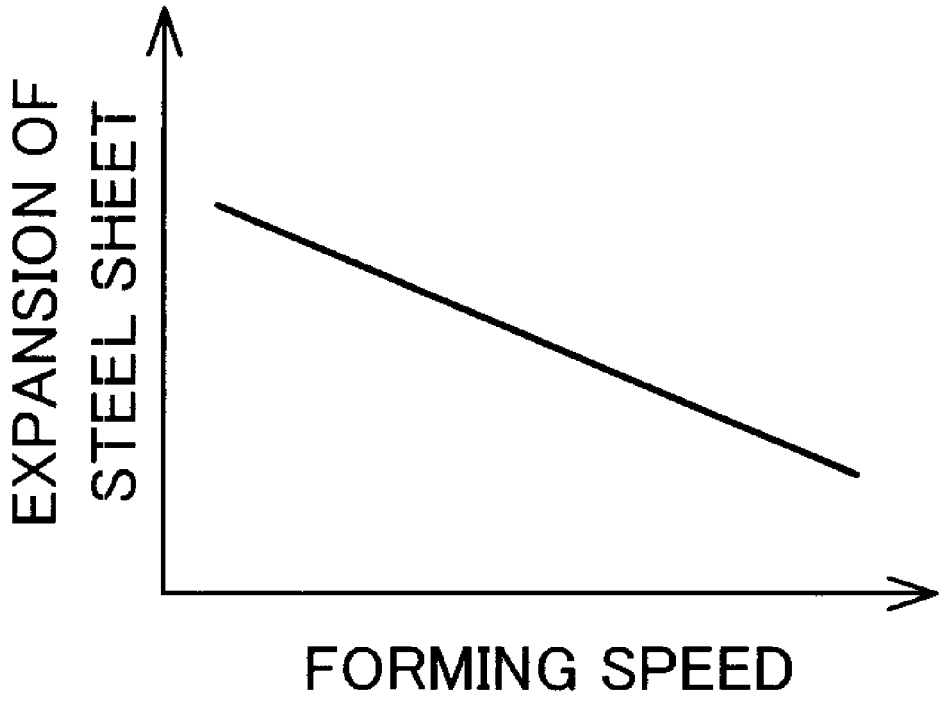
FIG. 20 is a graphic chart illustrating the relationship between the forming speed and the expansion of a work according to the embodiment.

FIG. 20 is a graphic chart illustrating the relationship between the forming speed and the expansion of a work. As shown in FIG. 20, the expansion of a work decreases as the forming speed increases. Accordingly, in the case of the bulge-forming in which the expansion of a work has a major impact on the forming limit, specifically the case in which the minimum principal strain is greater than 0, the sheet thickness decrease rate of a formed part decreases as the forming speed decreases, so that it is preferable that the forming speed is decreased.

Figure 21:
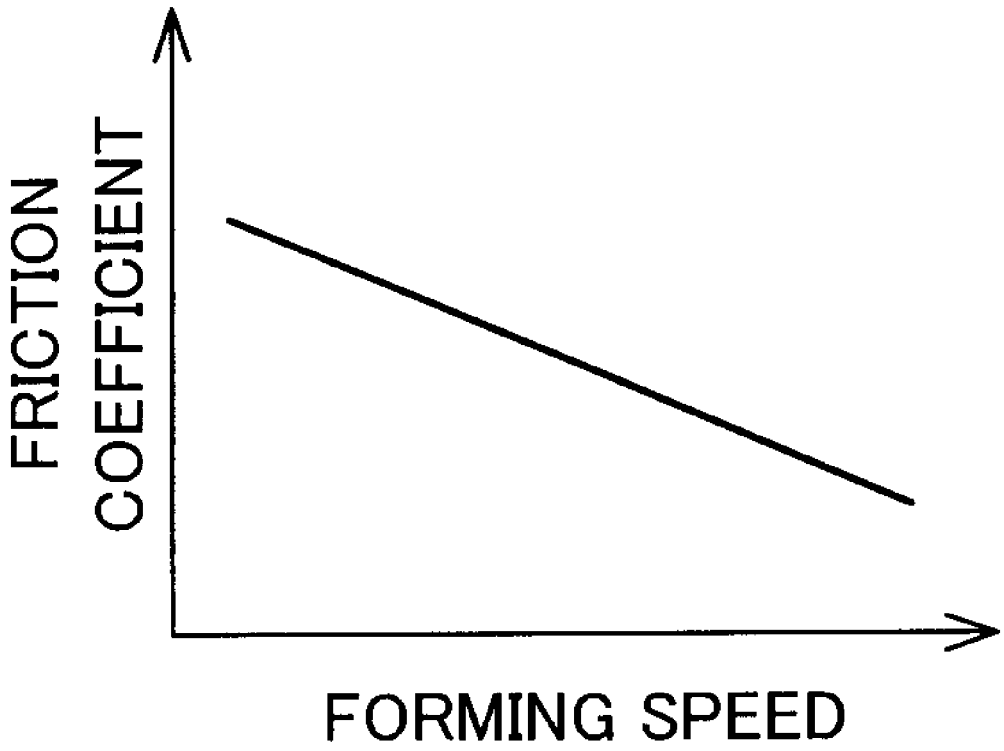
FIG. 21 is a graphic chart illustrating the relationship between the forming speed and the friction coefficient of a work with a die according to the embodiment.
Figure 22:
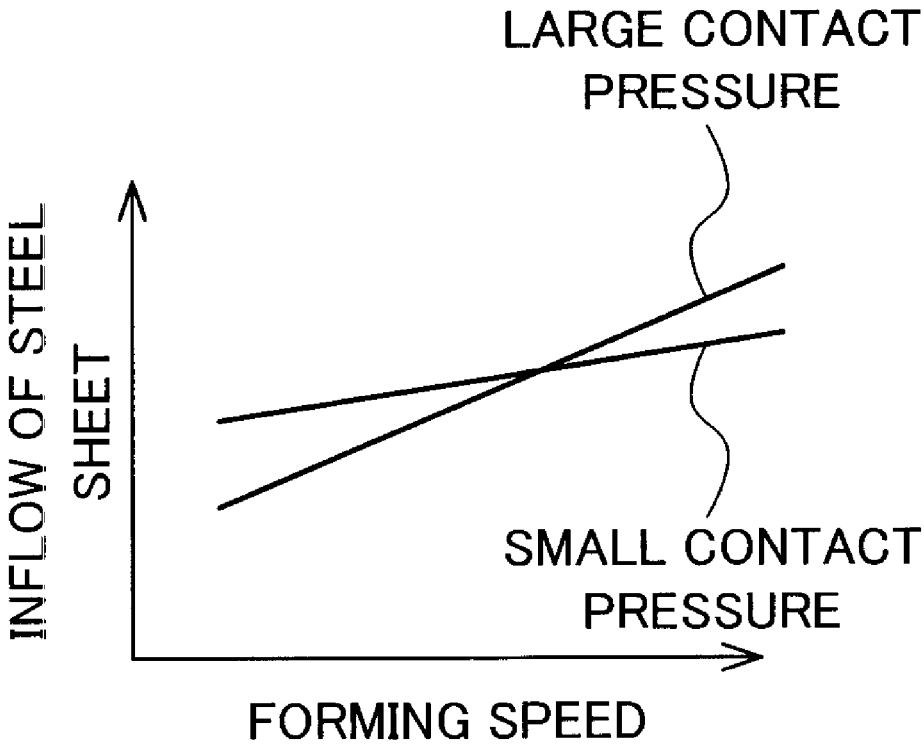
FIG. 22 is a graphic chart illustrating the relationship between the forming speed and the inflow of a work according to the embodiment.

FIG. 21 is a graphic chart illustrating the relationship between the forming speed and the friction coefficient of a work with a die. FIG. 22 is a graphic chart illustrating the relationship between the forming speed and the inflow of a work. As shown in FIG. 21, the friction coefficient of a work with a die decreases as the forming speed increases. Thus, as shown in FIG. 22, the inflow of a work increases as the forming speed increases. Accordingly, in the case of the draw-forming in which the inflow of a work has a major impact on the forming limit, specifically the case in which the minimum principal strain is 0 or less, the sheet thickness decrease rate of a formed part decreases as the forming speed increases, so that it is preferable that the forming speed is increased. In addition, the frictional impact increases as the contact pressure increases, so that the inflow of a steel sheet more significantly increases when the contact pressure is large than when it is small, as shown in FIG. 22.

Figure 23:
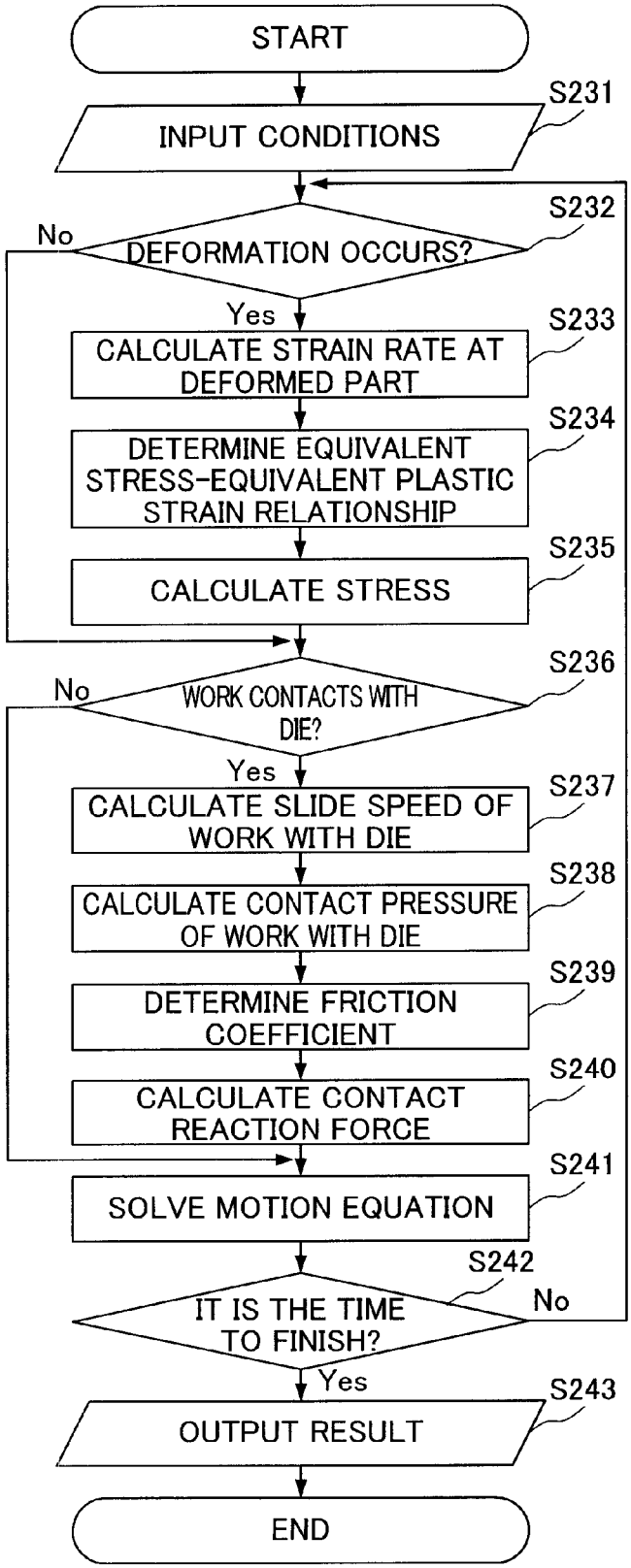
FIG. 23 is a flow chart illustrating the operation of the forming simulation means of the forming condition determination system according to the embodiment.

The step of the forming simulation analysis, which is the operation of the forming simulation means 215, is described below by using the flow chart of FIG. 23. In the step S231, analysis conditions are input. Specifically, the analysis conditions including the forming conditions such as the shape of a press-formed article, the shape and the material of a work, the forming speed, the fold pressure, and the stress-strain relation of a work, and the friction coefficient are input. The stress-strain characteristic depends on the strain rate, and the friction coefficient depends on the slide speed and the contact pressure of a work with a die.

In the step S232, it is determined whether or not deformation occurs. If this determination is "Yes", the process proceeds to the step S233. If this determination is "No", the process proceeds to the step S236.

In the step S233, the strain rate at a deformed part is calculated, and in the step S234, the stress-strain relation is determined based on this strain rate. The determination of the stress-strain relation is conducted every a predetermined cycle by a finish time.

Figure 24:
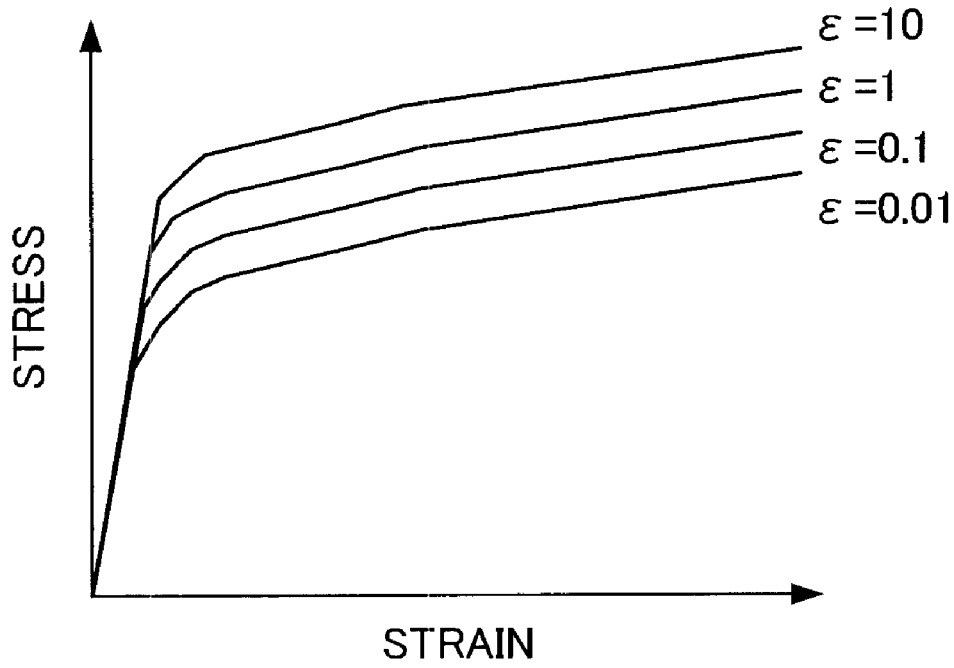
FIG. 24 is a diagram illustrating the stress-strain relation on forming simulation according to the embodiment.

FIG. 24 is a diagram illustrating the stress-strain relation. As shown in FIG. 24, the stress-strain relation depends on the strain rate, and the strain rate tends to increase at the same strain amount as the strain rate increases. Specifically, the strain rate decreases at the same strain amount as the strain rate decreases to 10, 1, 0.1, and 0.01 in order.

Figure 25:
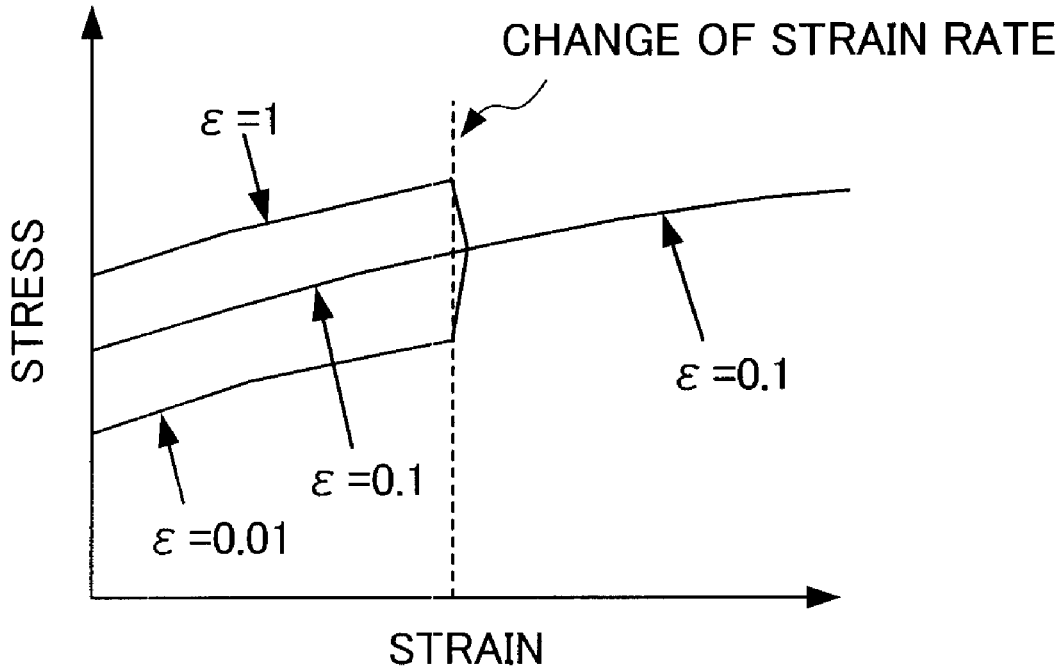
FIG. 25 is a diagram for explaining the case in which the strain rate of the stress-strain relation according to the embodiment changes.

In addition, as shown in FIG. 25, it is known that the stress-strain relation after the strain rate changes depends on only the strain rate after changing despite that before changing in the case in which the strain rate changes during deformation. Thus, the stress-strain relation after the strain rate changes is not affected by the strain rate history before the strain rate changes. Specifically, whether the strain rate is 1, 0.1, or 0.01, the stress applies to the graph of the strain rate of 0.1 when the strain rate changes to 0.1.

Then, the stress-strain relation is defined as follows, by using the equivalent stress and the equivalent plastic strain. The equivalent stress is a stress converted to uniaxial extension, and the equivalent plastic strain is a plastic strain converted to uniaxial extension. This conversion facilitates simple comparison and strength evaluation. Specifically, as shown in FIG. 26, the relationship between the predetermined equivalent plastic strain and the predetermined equivalent stress is determined at the predetermined strain rate by experimentation and the like to generate dot string data.

The predetermined strain rate is 0.01, 0.1, 1, and 10, and the predetermined equivalent plastic strain is 0, 0.05, 0.1, 0.15, 0.2, 0.25, or more values with 0.05 increments, herein. Subsequently, dot string data are plotted on the graph chart as shown in FIG. 27, and then the plotted points are connected with a straight line.

However, when the strain rate and the equivalent plastic strain for calculation are not included in the above-mentioned dot string data, the equivalent stress-equivalent plastic strain relation cannot be determined directly from the dot string data, thus being determined by the following steps. When the equivalent plastic strain for calculation is located between two equivalent plastic strains as defined in FIG. 27, the equivalent stress-equivalent plastic strain relation is determined by using the interpolation values of these two equivalent plastic strains.

Figure 27:
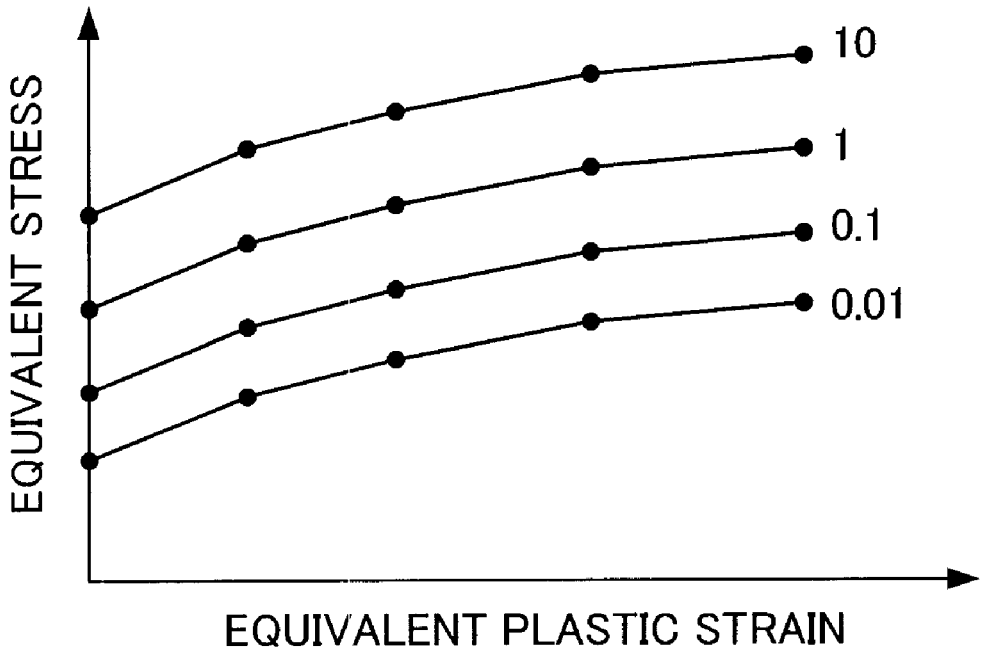
FIG. 27 is a diagram on which dot string data of the equivalent stress according to the embodiment are plotted.

When the equivalent strain rate for calculation is located between two strain rates as defined in FIG. 27, the equivalent stress-equivalent plastic strain relation is determined by using the interpolation values of these two strain rates. The above-mentioned interpolation values may be determined by using a direct (linear) function, a quadratic function, or a higher dimensional function.

However, the equivalent strain rate for calculation is greater than the maximum strain rate as defined in FIG. 27, the equivalent stress-equivalent plastic strain relation at the define maximum strain rate is used. Meanwhile, the equivalent strain rate for calculation is less than the minimum strain rate as defined in FIG. 27, the equivalent stress-equivalent plastic strain relation at the defined minimum strain rate is used. Therefore, the extrapolation value of the strain rate is not used.

Figure 28:
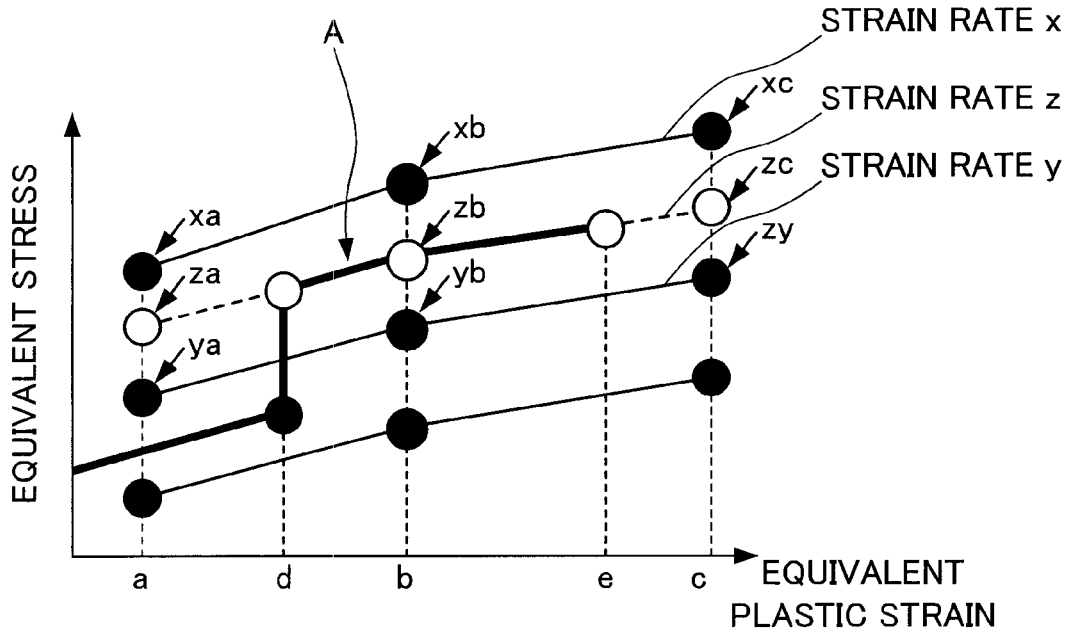
FIG. 28 is a diagram for explaining the step of determining the interpolation value of the equivalent stress according to the embodiment.

For example, as shown in FIG. 28, the dot string data at the strain rate x are defined as xa, xb, and xc, and the dot string data at the strain rate y are defined as ya, yb, and yc. When the equivalent stresses at the equivalent plastic strains d and e at the strain rate z is determined, the interpolation values of the dot string data at the two strain rates x and y are the dot string data at the strain rate z. Then, among dot string data at this strain rate z, the interpolation values of the equivalent stresses za, zb, and zc at the respective equivalent plastic strains a, b, and c are defined as the equivalent stresses at the equivalent plastic strains d and e at the strain rate z. Accordingly, as shown in the heavy line A in FIG. 28, the equivalent stress-equivalent plastic strain relations at any strain rates are easily computable. Furthermore, the equivalent stress-equivalent plastic strain relation after the strain rate changes is also easily computable even if the strain rate changes during deformation.

In the step S235, the stress at a deformed part is calculated by using the selected equivalent stress-equivalent plastic strain relation. In the step S236, it is determined whether or not a work contacts with a die. If this determination is "Yes", the process proceeds to the step S237. If this determination is "No", the process proceeds to the step S241.

In the step S237, the slide speed of a work with a die is calculated. In the step S238, the contact pressure of a work with a die is calculated. Subsequently, in the step S239, the friction coefficient is determined based on the contact pressure and the slide speed of a work with a die. The determination of the friction coefficient is conducted every a predetermined cycle by a finish time.

Figure 29:
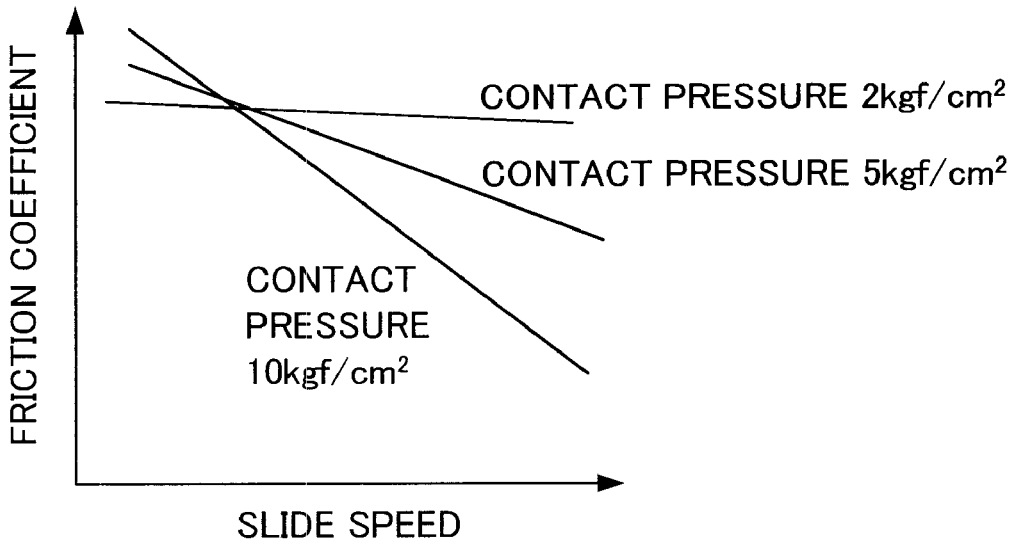
FIG. 29 is a chart illustrating the relationship between the slide speed and the contact pressure, and the friction coefficient on forming simulation according to the embodiment.

FIG. 29 is a diagram illustrating the relationship between the slide speed and the contact pressure, and the friction coefficient. As shown in FIG. 29, when fluid having a lubrication function such as treated oil between a work and a die exists, the friction coefficient depends on the slide speed of a work with a die and tends to decreases as the slide speed increases. In addition, the friction coefficient tends to depend on the slide speed more sufficiently as the contact pressure of a work with a tool increases. Thus, when the contact pressure of a work with a tool increases, the friction coefficient decreases as the slide speed increases. In fact, the contact area of a work with a die is small in draw-forming, so that the contact pressure tends to increase while the contact area is large in bulge-forming, so that the contact pressure tends to decrease.

Figure 31:
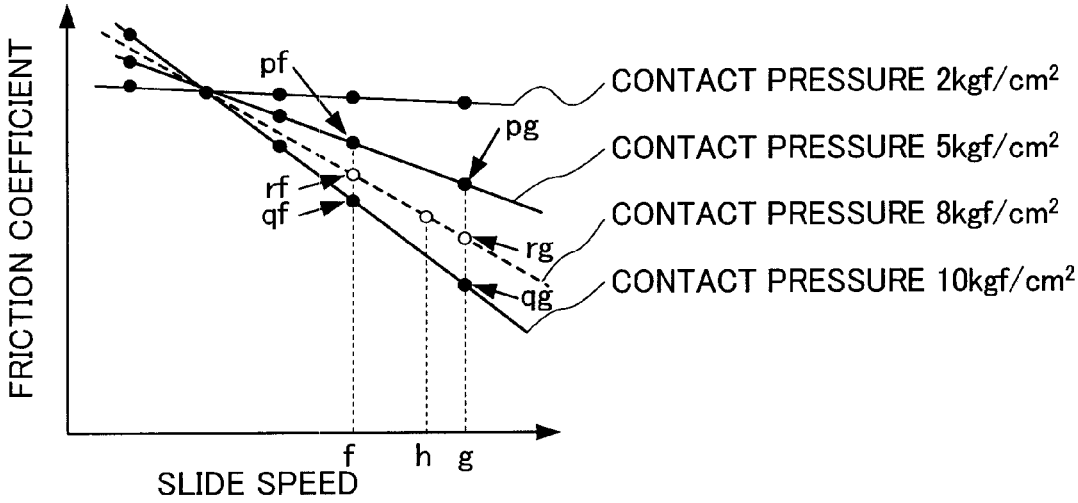
FIG. 31 is a diagram on which dot string data of the friction coefficient according to the embodiment are plotted.

Then, the relationship between the slide speed and the contact pressure, and the friction coefficient is defined as follows. Specifically, as shown in FIG. 30, the relationship between the predetermined slide speed and the predetermined friction coefficient is determined at the predetermined contact pressure by experimentation and the like to generate dot string data. The contact pressure of the predetermined is 1, 2, 5, and 10, and the predetermined slide speed is 1, 5, 10, and 50, 100, and 200, herein. Subsequently, dot string data are plotted on the graph chart as shown in FIG. 31, and then the plotted points are connected with a straight line.

However, when the slide speed and the contact pressure for calculation are not included in the above-mentioned dot string data, the relationship between the slide speed and the contact pressure, and the friction coefficient cannot be determined directly from the dot string data, thus being determined by the following steps. When the slide speed for calculation is located between two slide speeds as defined in FIG. 30, the relationship between the slide speed and the contact pressure, and the friction coefficient is determined by using the interpolation values of these two slide speeds.

When the contact pressure for calculation is located between two contact pressures as defined in FIG. 30, the relationship between the slide speed and the contact pressure, and the friction coefficient is determined by using the interpolation values of these two contact pressures. The above-mentioned interpolation values may be determined by using a direct (linear) function, a quadratic function, or a higher dimensional function.

However, when the contact pressure for calculation is greater than the maximum contact pressure as defined in FIG. 30, the relationship between the slide speed and the contact pressure, and the friction coefficient is used at the defined maximum contact pressure. Meanwhile, when the contact pressure for calculation is less than the minimum contact pressure as defined in FIG. 30, the relationship between the slide speed and the contact pressure, and the friction coefficient is used at the defined minimum contact pressure. Therefore, the extrapolation value of the contact pressure is not used.

For example, as shown in FIG. 31, the dot string data of a contact pressure of 5 kgf/cm$^2$ is defined as pf and pg, the dot string data of a contact pressure of 10 kgf/cm$^2$ is defined as of and qg. When the friction coefficient at the slide speed h of a contact pressure of 8 kgf/cm$^2$ is determined, the interpolation values of the dot string data at the two contact pressures of 5 kgf/cm$^2$ and 10 kgf/cm$^2$ are the dot string data of a contact pressure of 8 kgf/cm$^2$. Then, among dot string data of this contact pressure of 8 kgf/cm$^2$, the interpolation values of the friction coefficients rf and rg at the respective slide speed f and g are defined as friction coefficients at the slide speed h of a contact pressure of 8 kgf/cm$^2$.

Subsequently, in the step S240, the contact reaction force at the contacted part is calculated. In the step S241, the motion equation of each element is solved. In the step S242, it is determined whether or not it is the time to finish. If the determination is "No", the process returns to the step S232. If the determination is "Yes", the result is output (step S243), and then the process ends. This output result includes the maximum principal strain and the minimum principal strain to be the indices of wrinkles and surface strain.

The present embodiment provides the following effects.

(2) The forming simulation means 215 conducts forming simulation, and then the strain distribution chart plotting means 216 produces a strain distribution chart based on the result of the forming simulation. Then, the determination means 217 extracts the most crackable point as the maximum crack risk point $Q_A$ among the points plotted on the strain distribution chart. The quality of a formed article is determined on this basis.

At this point, when it is determined that the quality of a formed article unsatisfies a certain standard, and when the minimum principal strain at the maximum crack risk point $Q_A$ is 0 or less, it is assumed that draw-forming is predominant in this formed article, and thus the forming speed fluctuation means 218 increases the forming speed. Meanwhile, when it is determined that the quality of a formed article unsatisfies a certain standard, and when the minimum principal strain at the maximum crack risk point $Q_A$ is greater than 0, it is assumed that bulge-forming is predominant in this formed article, and thus the forming speed fluctuation means 218 decreases the forming speed.

These processes by the forming simulation means 215, the strain distribution chart plotting means 216, and the determination means 217 are repeated until it is determined that the quality of a formed article satisfies a certain standard, whereby the optimum forming speed in accordance with the shape of a formed article is automatically determined. Therefore, the forming speed of the pressing machine 230 can be determined appropriately and promptly, compared with the case to determine the forming speed based on intuition and experience of an operator in a conventional way. In addition, according to the present invention, the forming speed can be automatically determined, so that the number of times of trials using the real pressing machine 230 and a real material can be reduced considerably, which leads to reduce the cost. Furthermore, the forming conditions are expected by using the forming condition determination system 201 of the present invention during the stage of designing the shape of a product, whereby a product with a complex shape can be formed.

Third Embodiment

Figure 32:
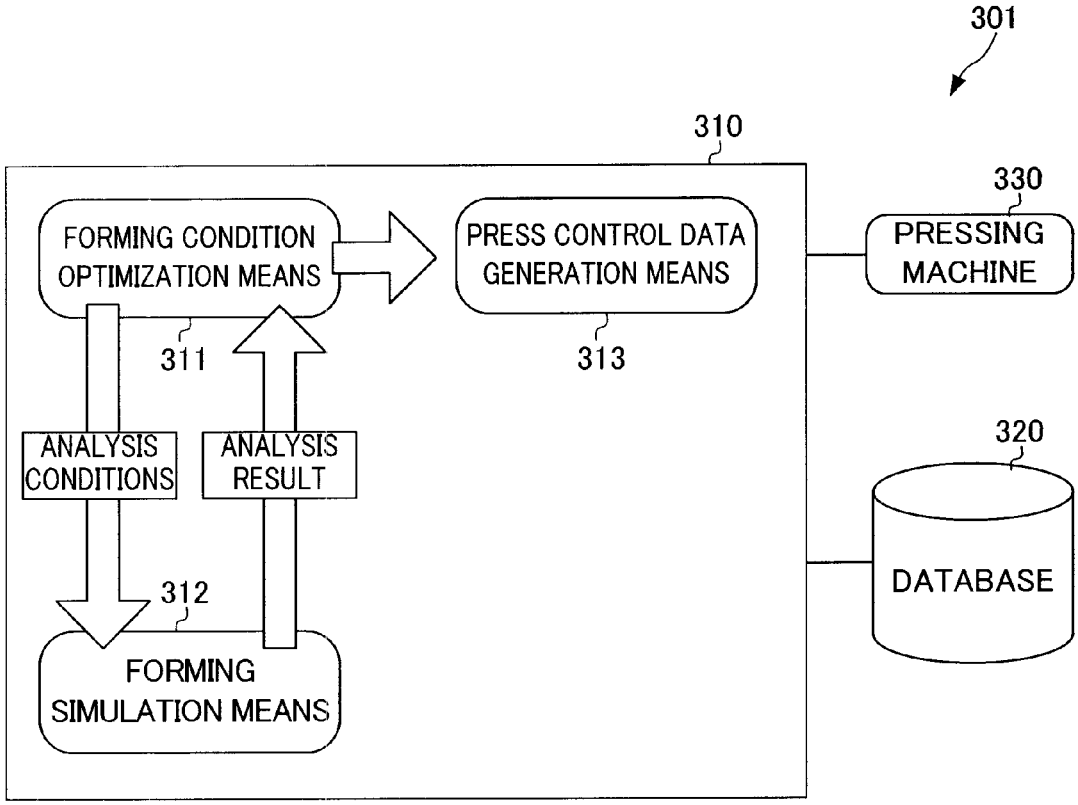
FIG. 32 is a schematic configuration diagram of the forming condition determination system according to the third embodiment of the present invention.

FIG. 32 is a schematic configuration diagram of the forming condition determination system 301 according to the third embodiment of the present invention. The forming condition determination system 301 is connected with the pressing machine 330, which is provided with the operation processing device 310 executing various programs and the storage device 320 for storing information in a hard disk and the like. The pressing machine 330 is a servo pressing machine driven with a servo. The forming condition determination system 301 outputs the pressing condition including the slide speed and the die cushion pressure to this pressing machine 330.

The forming condition determination system 301 is provided with the forming condition optimization means 311, the forming simulation means 312, and the press control data generation means 313 as programs developed on OS (Operating System) conducting operation control.

The forming simulation means 312 conducts the forming-processing simulation analysis. Specifically, when the analysis condition is input, the forming simulation means 312 conducts forming simulation under this analysis condition, and then outputs the analysis result. The storage device 320 is a data base, in which the operating conditions of the pressing machine 330 such as the ranges of the slide speed, the sliding acceleration, and the die cushion pressure are stored. These operating conditions are preset based on the cycle time and the conveyance speed, and the like.

The forming condition optimization means 311 generates a plurality of kinds of forming conditions with reference to the operating conditions stored in the storage device 320 to output these forming conditions to the forming simulation means 312 as analysis conditions. Subsequently, the forming condition optimization means 311 receives the analysis result from the forming simulation means 312, and then the optimum forming condition is determined based on this analysis result. The press control data generation means 313 generates data for operating the pressing machine 330 based on the forming conditions determined by the forming condition optimization means 311.

Figure 33:
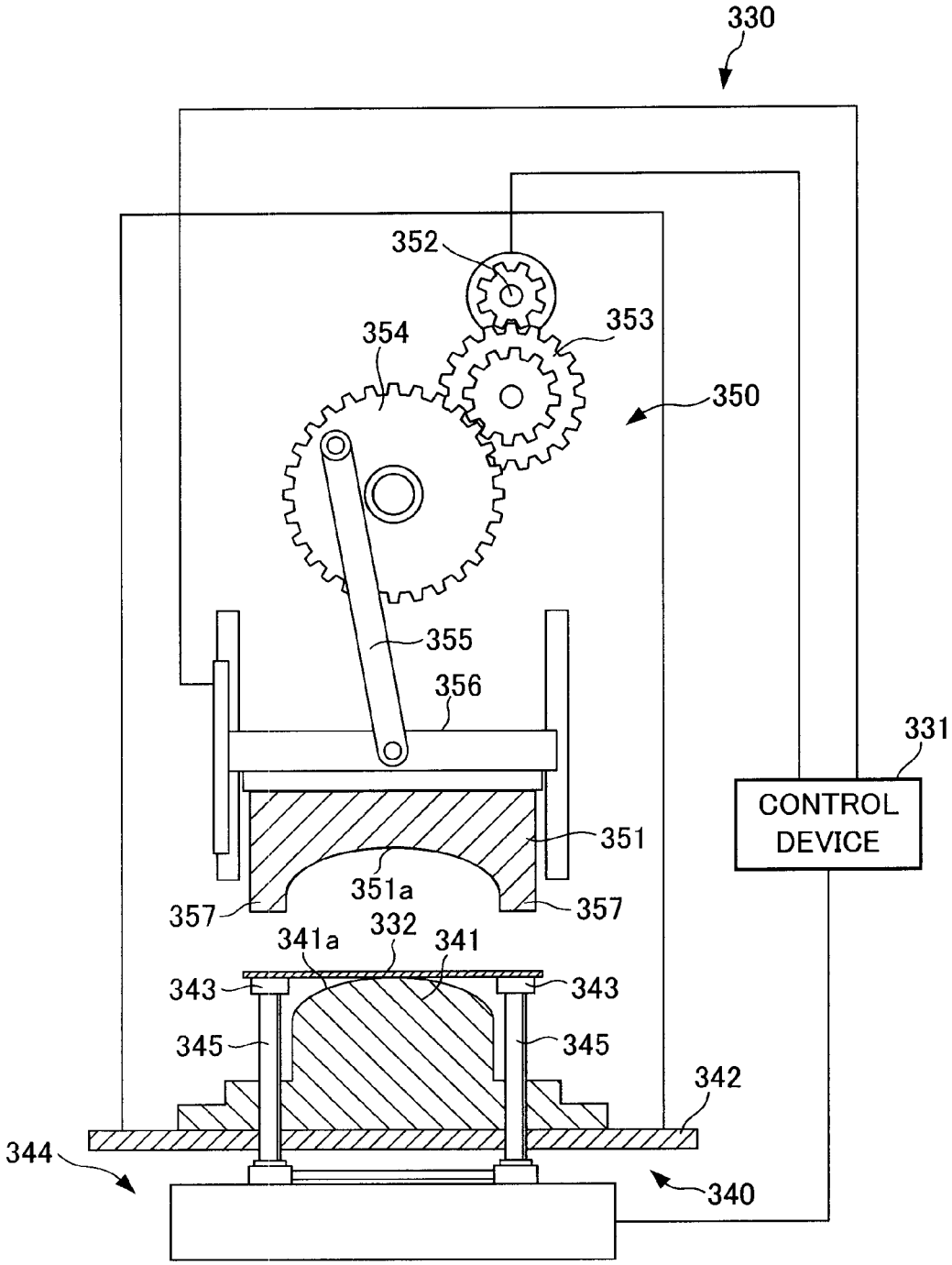
FIG. 33 is a schematic configuration diagram of a pressing machine of the forming condition determination system according to the embodiment of the present invention.

FIG. 33 is a diagram illustrating a schematic configuration of the pressing machine 330. The pressing machine 330 is a so-called servo pressing machine, which is provided with the lower die mechanism 340 having the lower die 341 placed at the lower side of the steel sheet 332 as a work, the upper die mechanism 350 bringing the upper die 351 to approach to and isolate from the lower die 341, and the control device 331 controlling the lower die mechanism 340 and the upper die mechanism 350.

The upper die mechanism 350 has the servo motor 352, the reduction gear 353 rotarily driven by the servo motor 352, the rotating plate 354 rotarily driven at large torque by the reduction gear 353, and the connecting rod 355, the top part or which is pivoted swingably with the top part the side face of the rotating plate 354.

The servo motor 352 is of an AC type for example, having high response and low irregular torque. The shaft rotational position of the servo motor 352 is detected by an encoder (not shown), and then feedback control of the servo motor 352 is conducted based on this detected shaft rotational position.

The upper die mechanism 350 is further provided with the slider 356 pivoted to the bottom end of the connecting rod 355, in which the upper die 351 is provided at the lower face of the slider 356.

The steel sheet 332 is placed between the upper die 351 and the lower die 341 for conducting press-forming. The upper die 351 is provided with the die face 351*a* at the lower face for abutting the upper face of the steel sheet 332. This die face 351*a* has a concavo curve, and the ring-like holder 357 is provided around the upper die 351. The top end face of the holder 357 is the horizontal, which projects to some extent before the die face 351*a*. Therefore, the holder 357 abuts the steel sheet 332 before the form side 351*a*.

In addition to the lower die 341, the lower die mechanism 340 has the fixed base 342 to be a base, the ring-like blank holder 343 supporting the peripheral part of the steel sheet 332, and the die cushion mechanism 344 lifting and lowering the blank holder 343.

The lower die 341 is provided at the upper part of the fixed base 342, and the steel sheet 332 is placed between the lower die 341 and the upper die 351 for conducting press-processing. On the upper face of this lower die 341, the die face 341*a* is provided for contacting with the lower face of the steel sheet 332.

The blank holder 343 is provided at the position opposed to the holder 357. The end part of the steel sheet 332 is held between the blank holder 343 and the holder 357 in order to prevent wrinkle generation, displacement, and the like when the steel sheet 332 is pressed.

The die cushion mechanism 344 has a plurality of kinds of the pins 345 penetrating the fixed base 342 and the lower die 341 from the lower side to support the lower part of the blank holder 343, and a hydraulic lifting and lowering mechanism (not shown) lifting and lowering these pins 345.

The lifting and lowering mechanism is configured by including a hydraulic: cylinder (not shown) connected with the pins 345 and a servo equipment (not shown) driving this hydraulic cylinder. This servo equipment is connected with the control device 331. The blank holder 343 and the holder 357 press the peripheral part of the steel sheet 332 to be folded at appropriate pressure (die cushion pressure) by conducting the predetermined pressure control based on a signal from the control device 331.

The control device 331 rotarily drives the servo motor 352 to advance the upper die 351 to the lower die 341 and retrieves the upper die 351 from the lower die 341, and drives the die cushion mechanism 344 to lift and lower the blank holder 343.

Figure 34:
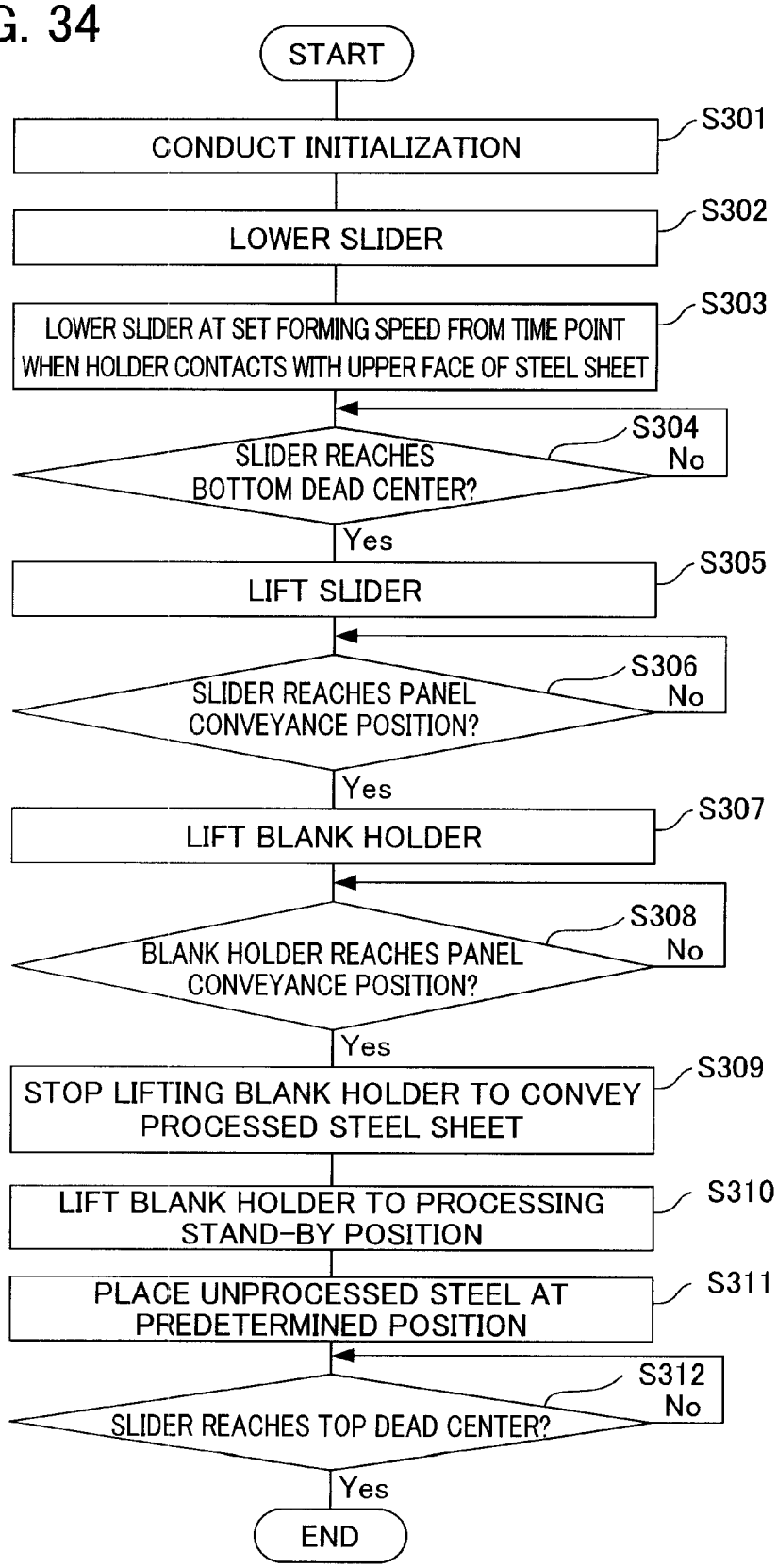
FIG. 34 is a flow chart illustrating the pressing steps of a pressing machine according to the embodiment.

The step of processing the steel sheet 332 by using the above-mentioned pressing machine 330 is described below with reference to FIG. 34.

Initialization is first conducted in the step S301. That is, the blank holder 343 is lifted to the predetermined position to support the unprocessed steel sheet 332. In addition, the upper die 351 lifts to the top dead center. In the step S302, the servo motor 352 is rotarily driven to lower the slider 356, under action of the control device 331.

When the slider 356 is lowered to some extent, the holder 357 contacts with the upper face of the steel sheet 332, and then the steel sheet 332 is held between the holder 357 and the blank holder 343. From this point, the blank holder 343 is lowered under action of the control device 331 (Step S303). Specifically, pressure control is conducted to lower the steel sheet 332 to be maintained firmly by generating moderate force so that the black holder 343 presses the lower face of the steel sheet 332 in some degree under action of the control device 331. That is, the blank holder 343 is pressed by the holder 357 through the steel sheet 332, thereby applying moderate pressure to the steel sheet 332 to be depressed. As a result, the steel sheet 332 is lowered with the peripheral part held (placed) by the holder 357 and the blank holder 343, and then gradually pressed into a product shape by the upper die 351 and the lower die 341.

In the step S304, the control device 331 brings the position of the slider 356 to reach the bottom dead center that is the most inferior point during one stroke of the upper die 351. In step S305, the servo motor 352 is rotarily driven to lift the slider 356 to the panel conveyance position, under action of the control device 331.

In the step S306, it is checked whether or not the position of the slider 356 reaches the panel conveyance position. If the position of the slider 356 reaches the panel conveyance position, the process proceeds to the step S307. Otherwise the slider 356 continues to be lifted. In the step S307, the blank holder 343 is lifted under action of the control device 331. Thus, the blank holder 343 delays in some degree to be lifted after the slider 356.

In the step S308, the blank holder 343 is lifted to the panel conveyance position, under action of the control device 331. In the step S309, the lifting of the blank holder 343 is stopped temporarily to convey the draw-formed steel sheet 332 to the station of the next step by a conveyance means (not shown).

In the step S310, the control device 331 lifts the blank holder 343 again to bring the blank holder 343 to reach the processing stand-by position. In the step S311, an unprocessed steel sheet is placed to the predetermined position. In this period, the slider 356 continues to be lifted. In the step S312, the control device 331 brings the slider 356 to reach the top dead center.

Figure 35:
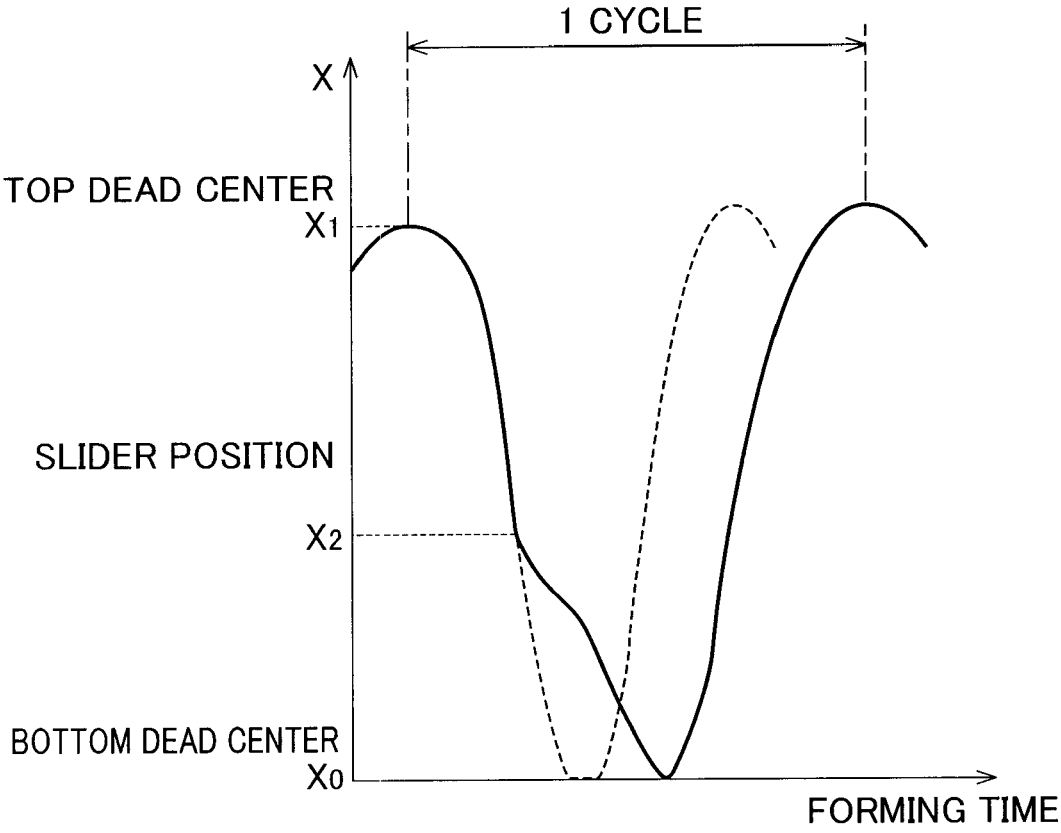
FIG. 35 is a diagram illustrating the relationship between the slider displacement and the forming time of a pressing machine according to the embodiment.

The slider displacement of the pressing machine 330 is described below with reference to FIG. 35. In the above-mentioned draw-forming, the slider 356, which is the upper die 351, is displaced as shown in FIG. 35 to conduct draw-processing. Specifically, the upper die 351 is lowered from the top dead center ($X_1$) at the predetermined slide speed, and then the speed is decreased just before the position ($X_2$) which the upper die 351 contacts with a steel sheet. Accordingly, the upper die 351 contacts with a steel sheet at this decreased slide speed, and then press-forming is conducted by increasing the speed. When reaching the bottom dead center ($X_0$), the upper die 351 is lifted at the original slide speed (predetermined speed).

Figure 36:
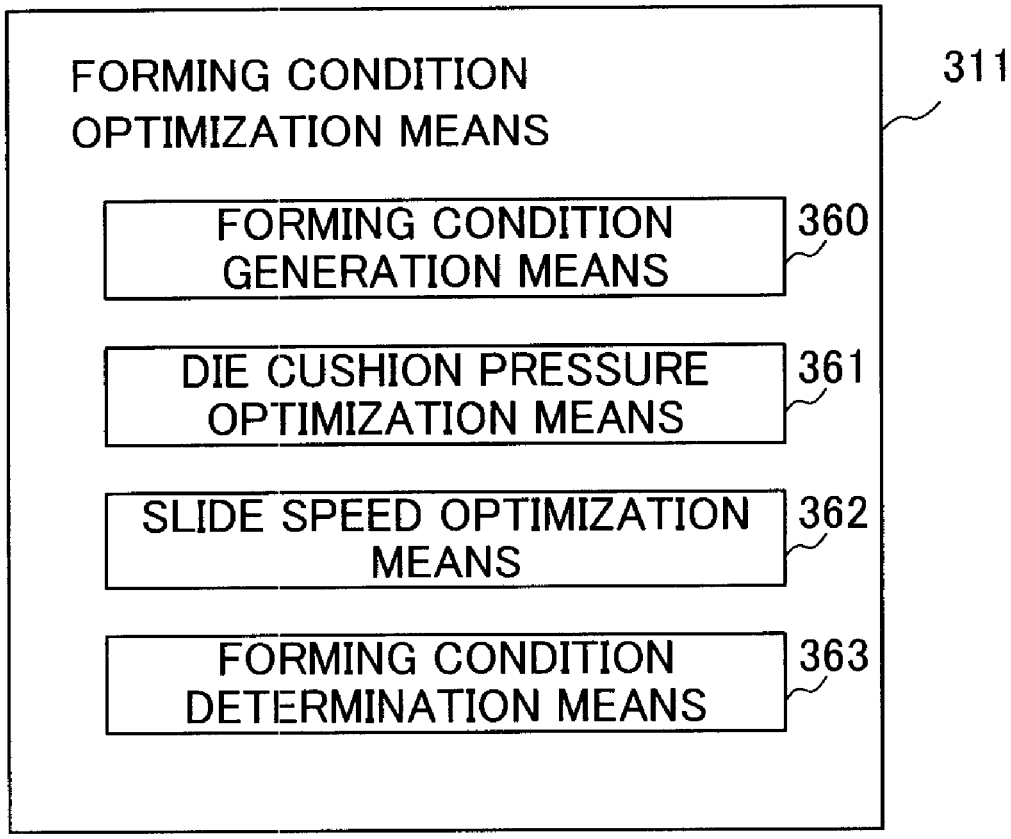
FIG. 36 is a block diagram of the forming condition optimization means according to the embodiment.

FIG. 36 is a block diagram of the forming condition optimization means 311. The forming condition optimization means 311 is provided with the forming condition generation means 360, the die cushion pressure optimization means 361, the slide speed optimization means 362, and the forming condition determination means 363. The forming condition generation means 360 generates a plurality of kinds of forming conditions with different combinations of the slide speed and the die cushion pressure, with reference to the operating conditions stored in the storage device 320.

The die cushion pressure optimization means 361 selects the optimum die cushion pressure among forming conditions generated by the forming condition generation means 360. The slide speed optimization means 362 selects the optimum slide speed among forming conditions generated by the forming condition generation means 360. The forming condition determination means 363 determines whether or not the quality of a press-formed article satisfies a certain standard, based on the result of the forming simulation analysis conducted by the forming simulation means 312.

The forming condition optimization means 311 operates the forming condition generation means 360 and then repeats the die cushion pressure optimization means 361, the forming condition determination means 363, the slide speed optimization means 362, and the forming condition determination means 363 in order until the forming condition determination means 363 determines that the quality of a press-formed article satisfies a certain standard.

Figure 37:
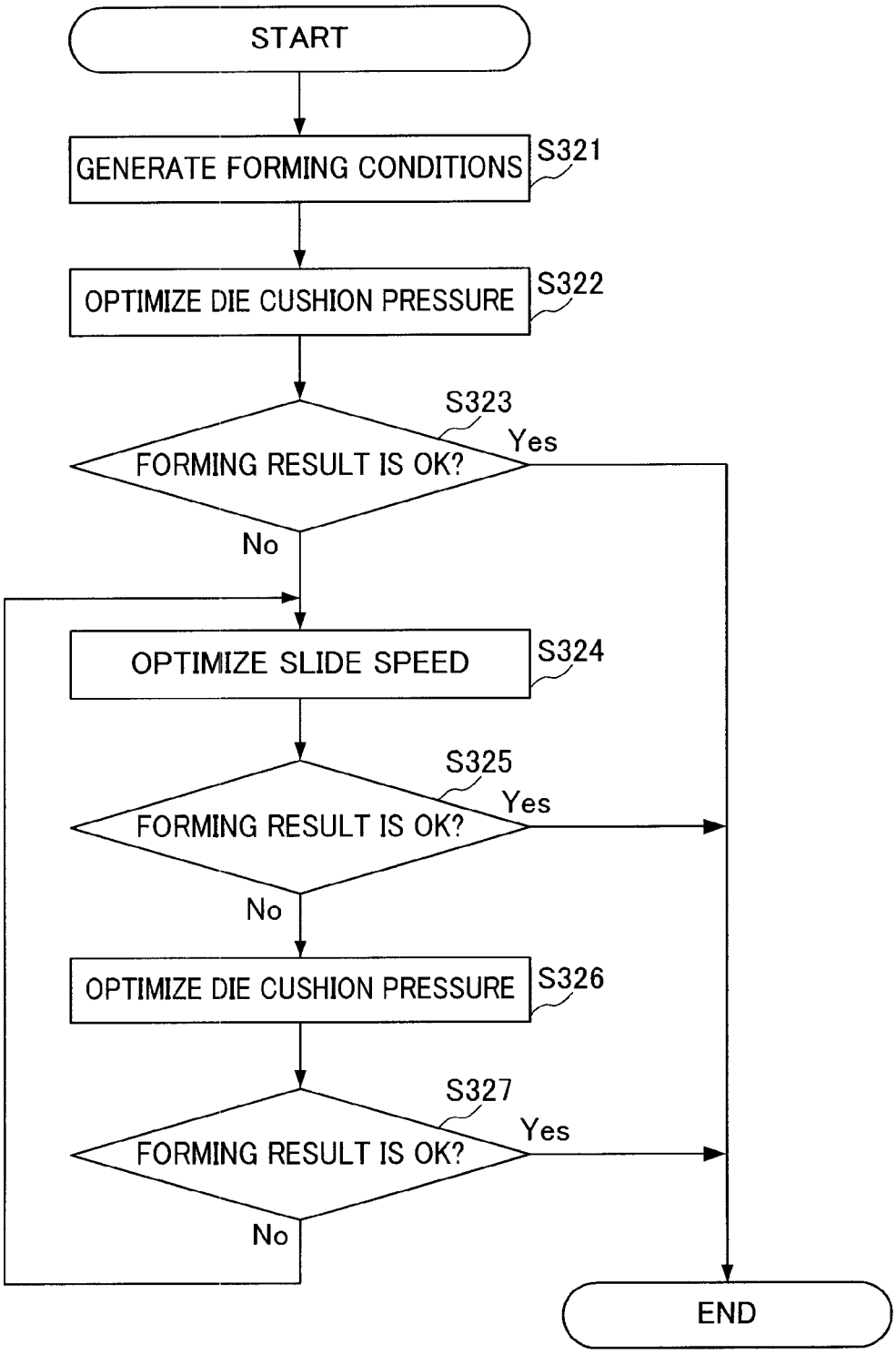
FIG. 37 is a flow chart illustrating operation of the forming condition optimization means according to the embodiment.

The operation of the forming condition optimization means 311 is described below by using the flow chart of FIG. 37. In the step S321, the forming condition generation means 360 generates a plurality of kinds of forming conditions with different combinations of the slide speed and the die cushion pressure, outputs these generated combinations to the forming simulation means 312 as analysis conditions, and then receives the analysis result from the forming simulation means 312.

Figure 38:
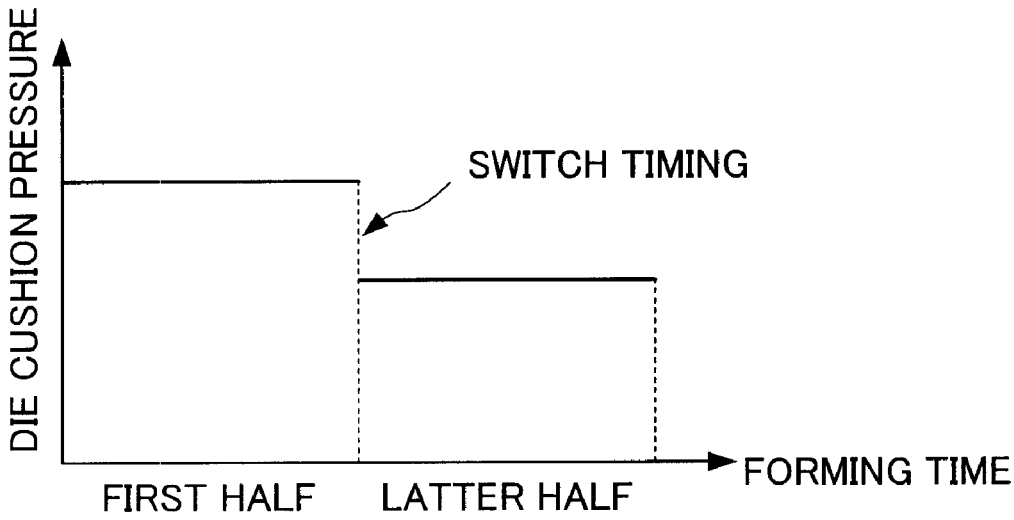
FIG. 38 is a diagram illustrating the relationship between the die cushion pressure and the forming time of a pressing machine according to the embodiment.

In the step S322, the die cushion pressure optimization means 361 optimizes the die cushion pressure of a pressing machine. FIG. 38 is a diagram illustrating the relationship between the die cushion pressure and the forming time of a pressing machine. As shown in FIG. 38, the die cushion pressure is set in two stages: the first half and the latter half of the cycle time. Therefore, the optimal values are searched for the die cushion pressures in the first half and in the latter half of the cycle time and the switch timing of the die cushion pressure.

In the step S323, the forming condition determination means 363 determines whether or not the quality of a press-formed article satisfies a certain standard, based on the result of the forming simulation analysis. Specifically, the forming condition determination means 363 determines whether or not the maximum value of the sheet thickness decrease rate is the predetermined value or less and whether or not the minimum principal strain is the predetermined value or more, by using the maximum value of the sheet thickness decrease rate and the minimum principal strain as indices evaluating a formed article. This is because when the sheet thickness decrease rate increases, the crack (fissure) is generated more easily, and when the minimum principal strain decreases, wrinkles and surface strain are generated more easily.

If the determination in the step S323 is "No", the maximum value of the sheet thickness decrease rate is the predetermined value or less is selected among the die cushion pressures optimized in the step S322, and then the process proceeds to the step S324. Meanwhile, if the determination in the step S323 is "Yes", the process ends.

Figure 39:
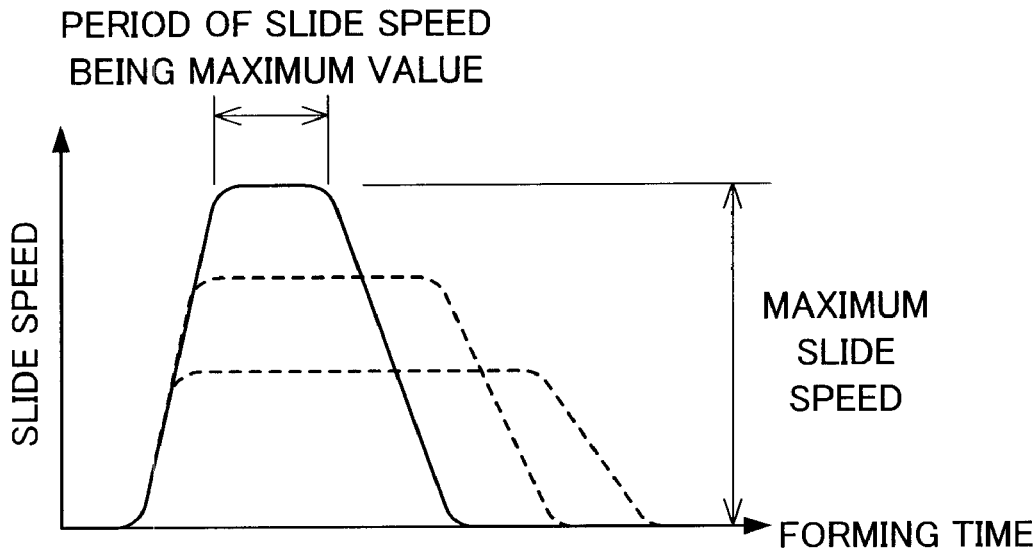
FIG. 39 is a diagram illustrating the relationship between the slide speed and the forming time of a pressing machine according to the embodiment.

In the step S324, the slide speed optimization means 362 optimizes the slide speed of a pressing machine. FIG. 39 is a diagram illustrating the relationship between the slide speed and the forming time of a pressing machine. As shown in FIG. 39, the optimal value is searched during the period when the slide speed is the maximum value and the slide speed is maximized.

In the step S325 as well as the step S323, it is determined whether or not the quality of a press-formed article satisfies a certain standard based on the result of the forming simulation analysis, by using the maximum value of the sheet thickness decrease rate and the minimum principal strain. If the determination of the step S325 is "No", the process proceeds to the step S326. If the determination is "Yes", the process ends.

In the step S326, the die cushion pressure is optimized again. This is because the die cushion pressure is optimized in the step S322 and the slide speed is optimized in step S324, so that it is necessary to fine adjust the die cushion pressure.

In the step S327 as well as the step S323, it is determined whether or not the quality of a press-formed article satisfies a certain standard based on the result of the forming simulation, by using the maximum value of the sheet thickness decrease rate and the minimum principal strain. If the determination of the step S327 is "No", the process proceeds to the step S324. If the determination is "Yes", the process ends.

Figure 40:
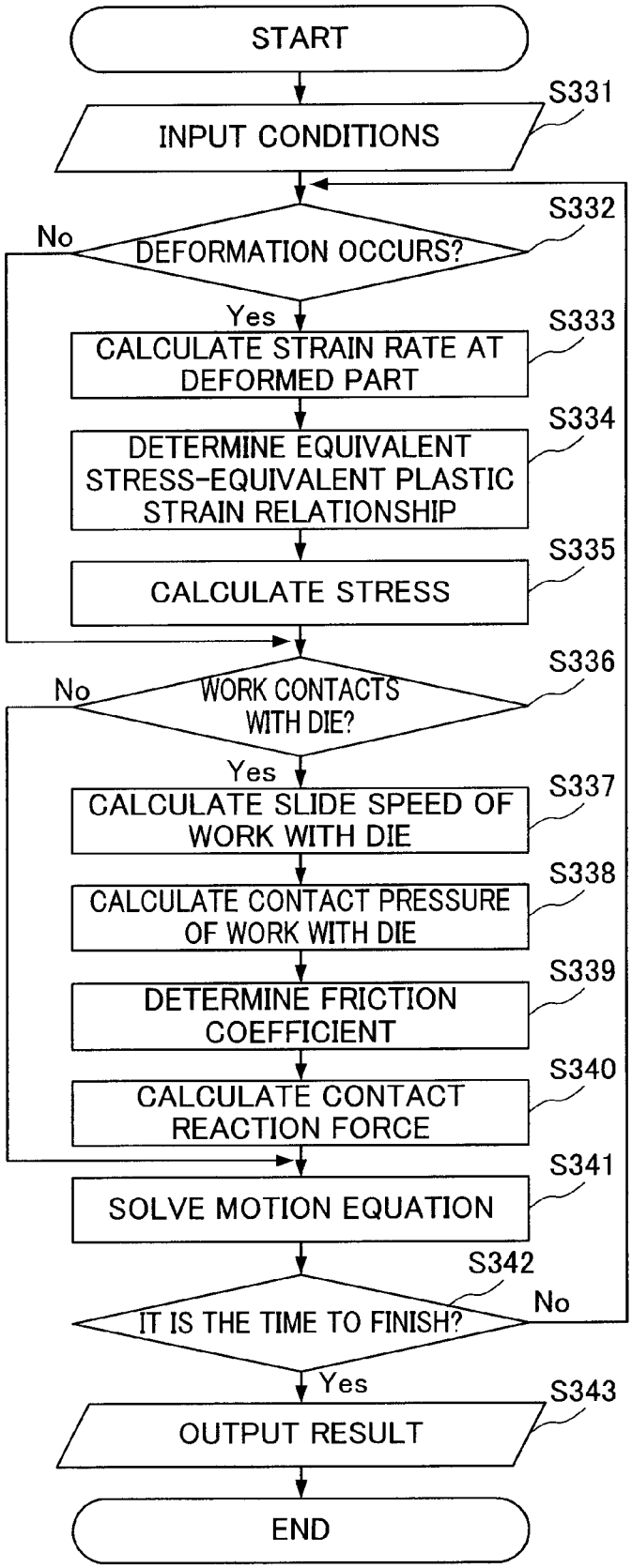
FIG. 40 is a flow chart illustrating the operation of the forming simulation means of the forming condition determination system according to the embodiment.

The operation of the forming simulation means 312 is described below by using the flow chart of FIG. 40. In the step S331, forming conditions are input. Specifically, the shape of a die of the pressing machine 330, the work shape, the slide speed, the die cushion pressure, the stress-strain relation of a work, and the friction coefficient are input. The stress-strain characteristic depends on the strain rate, and the friction coefficient depends on the slide speed and the contact pressure of a work with a die.

In the step S332, it is determined whether or not deformation occurs. If this determination is "Yes", the process proceeds to the step S333. If this determination is "No", the process proceeds to the step S336.

In the step S333, the strain rate at a deformed part is calculated, and in the step S334, the stress-strain relation is determined based on this strain rate. The determination of the stress-strain relation is conducted every a predetermined cycle by a finish time.

Figure 41:
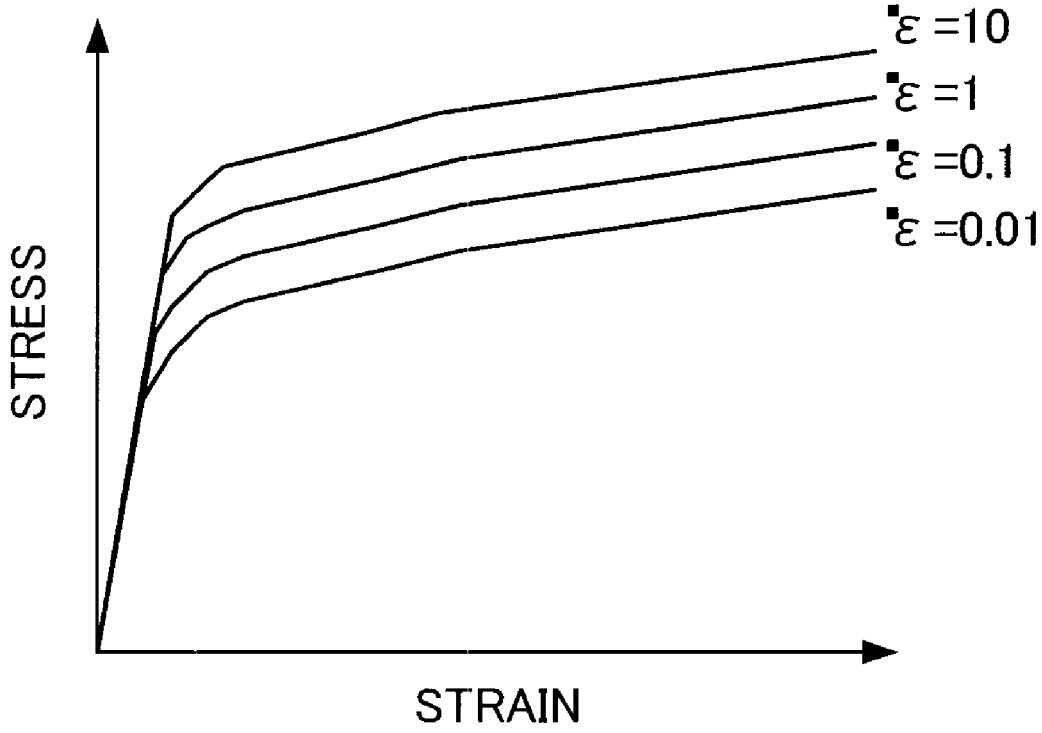
FIG. 41 is a chart illustrating the stress-strain relation on forming simulation according to the embodiment.

FIG. 41 is a diagram illustrating the stress-strain relation. As shown in FIG. 41, the stress-strain relation depends on the strain rate, and the stress tends to increase at the same strain amount as the strain rate increases. Specifically, the strain rate decreases at the same strain amount as the strain rate decreases to 10, 1, 0.1, and 0.01 in order.

Figure 42:
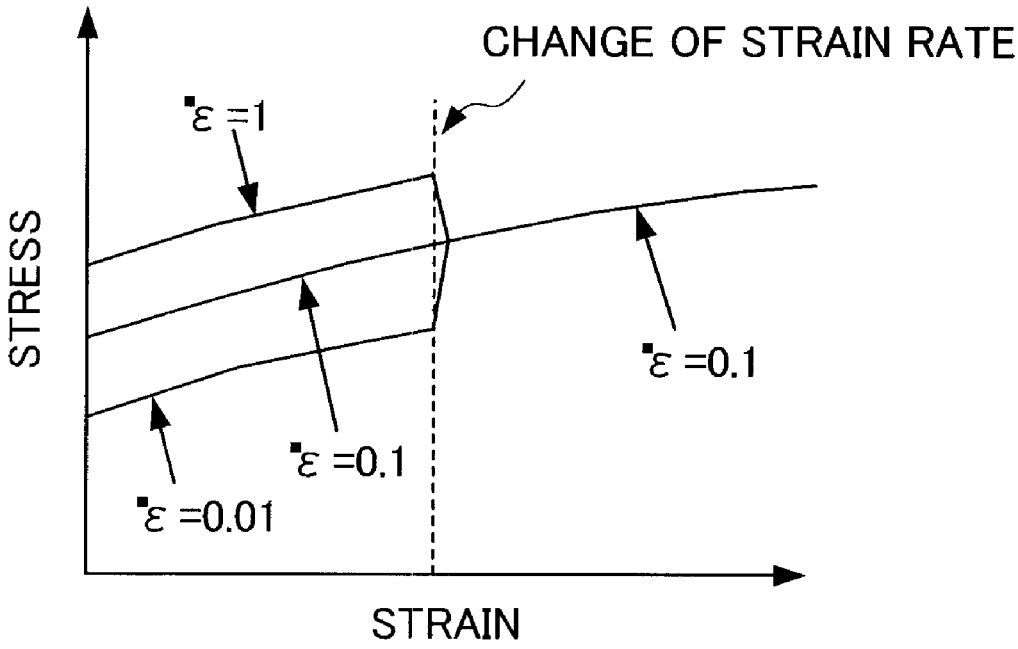
FIG. 42 is a diagram for explaining the case in which the strain rate of the stress-strain relation according to the embodiment changes.

In addition, as shown in FIG. 42, it is known that the stress-strain relation after the strain rate changes depends on only the strain rate after changing despite that before changing in the case in which the strain rate changes during deformation. Thus, the stress-strain relation after the strain rate changes is not affected by the strain rate history before the strain rate changes. Specifically, whether the strain rate is 1, 0.1, or 0.01, the stress applies to the graph of a strain rate of 0.1 when the strain rate changes to 0.1.

Then, the stress-strain relation is defined as follows, by using the equivalent stress and the equivalent plastic strain and. The equivalent stress is a stress converted to uniaxial extension, and the equivalent plastic strain is a plastic strain converted to uniaxial extension. This conversion facilitates simple comparison and strength evaluation. Specifically, as shown in FIG. 43, the relationship between the predetermined equivalent plastic strain and the predetermined equivalent stress is determined at the predetermined strain rate by experimentation and the like to generate dot string data.

Figure 44:
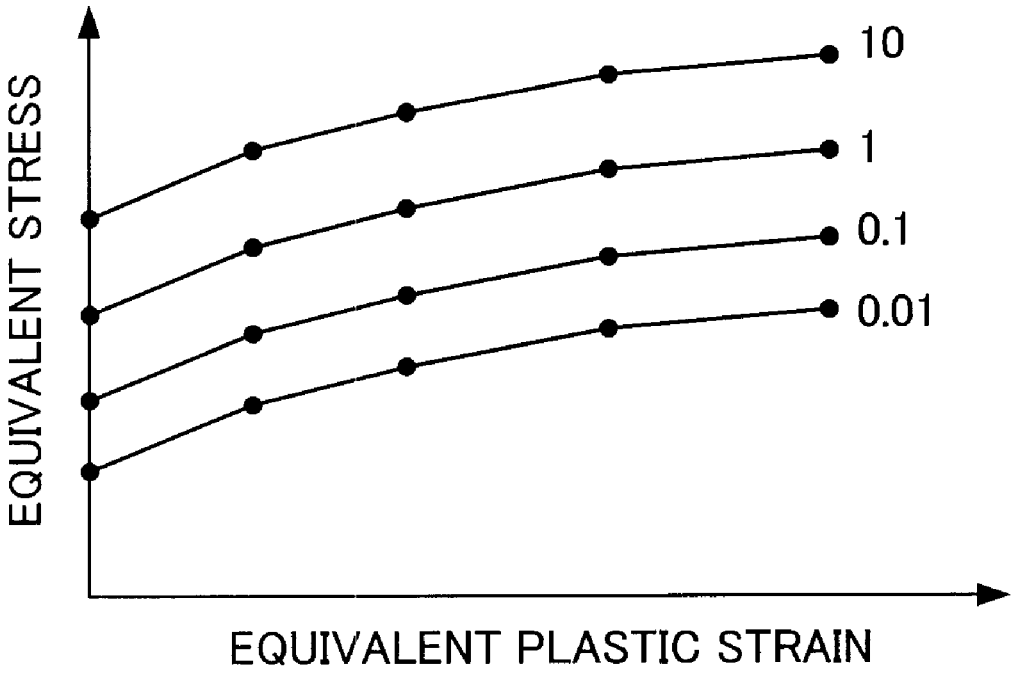
FIG. 44 is a chart on which dot string data of the equivalent stress according to the embodiment are plotted.

The predetermined strain rate is 0.01, 0.1, 1, and 10, and the predetermined equivalent plastic strain is 0, 0.05, 0.1, 0.15, 0.2, 0.25, or more values with 0.05 increments, herein. Subsequently, dot string data are plotted on the graph chart as shown in FIG. 44, and then the plotted points are connected with a straight line.

However, when the strain rate and the equivalent plastic strain for calculation are not included in the above-mentioned dot string data, the equivalent stress-equivalent plastic strain relation cannot be determined directly from the dot string data, thus being determined by the following steps. When the equivalent plastic strain for calculation is located between two equivalent plastic strains as defined in FIG. 43, the equivalent stress-equivalent plastic strain relation is determined by using the interpolation values of these two equivalent plastic strains.

When the equivalent strain rate for calculation is located between two strain rates as defined in FIG. 43, the equivalent stress-equivalent plastic strain relation is determined by using the interpolation values of these two strain rates. The above-mentioned interpolation values may be determined by using a direct (linear) function, a quadratic function, or a higher dimensional function.

However, when the equivalent strain rate for calculation is greater than the maximum strain rate as defined in FIG. 43, the equivalent stress-equivalent plastic strain relation at the defined maximum strain rate is used. Meanwhile, the equivalent strain rate for calculation is less than the minimum strain rate as defined in FIG. 43, the equivalent stress-equivalent plastic strain relation at the defined minimum strain rate is used. Therefore, the extrapolation value of the strain rate is not used.

Figure 45:
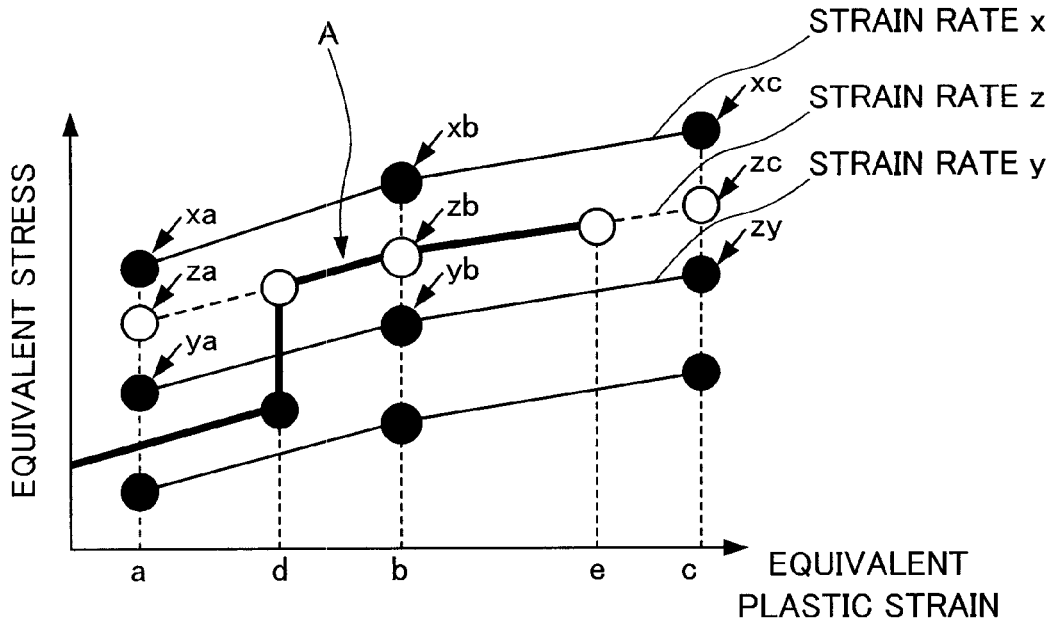
FIG. 45 is a diagram for explaining the step of determining the interpolation value of the equivalent stress according to the embodiment.

For example, as shown in FIG. 45, the dot string data at the strain rate x are defined as xa, xb, and xc, and the dot string data at the strain rate y are defined as ya, yb, and yc. When the equivalent stresses at the equivalent plastic strains d and e at the strain rate z is determined, the interpolation values of the dot string data at the two strain rates x and y are the dot string data at the strain rate z. Then, among dot string data at this strain rate z, the interpolation values of the equivalent stresses za, zb, and zc at the respective equivalent plastic strains a, b, and c are defined as the equivalent stresses at the equivalent plastic strains d and e at the strain rate z. Accordingly, as shown in the heavy line A in FIG. 45, the equivalent stress-equivalent plastic strain relations at any strain rates are easily computable. Furthermore, the equivalent stress-equivalent plastic strain relation after the strain rate changes is also easily computable even if the strain rate changes during deformation.

In the step S335, the stress at a deformed part is calculated by using the selected equivalent stress-equivalent plastic strain relation. In the step S336, it is determined whether or not a work contacts with a die. If this determination is "Yes", the process proceeds to the step S337. If this determination is "No", the process proceeds to the step S341.

In the step S337, the slide speed of a work with a die is calculated. In the step S338, the contact pressure of a work with a die is calculated. Subsequently, in the step S339, the friction coefficient is determined based on the contact pressure and the slide speed of a work with a die. The determination of the friction coefficient is conducted every a predetermined cycle by a finish time.

Figure 46:
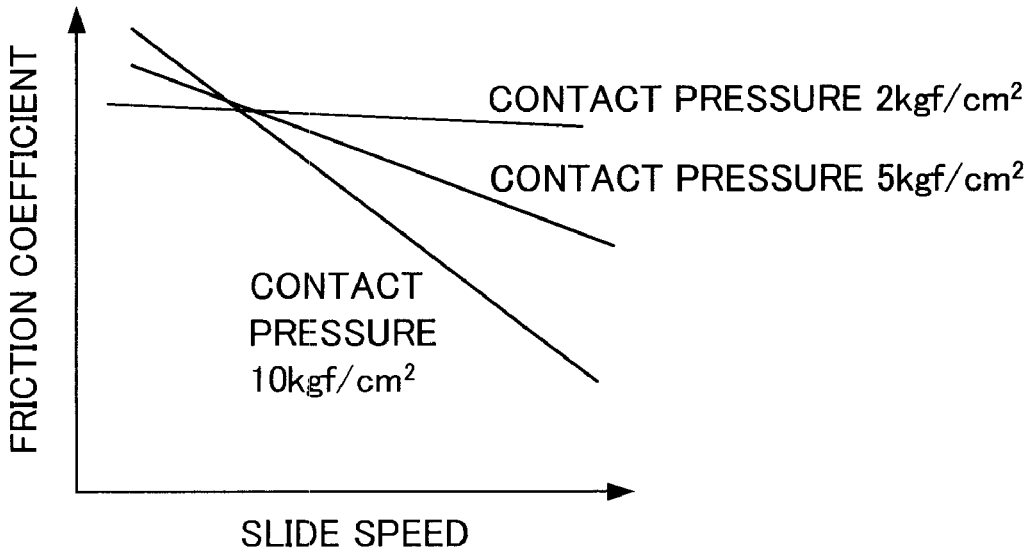
FIG. 46 is a chart illustrating the relationship between the slide speed and the contact pressure, and the friction coefficient on forming simulation according to the embodiment.

FIG. 46 is a diagram illustrating the relationship between the slide speed and the contact pressure, and the friction coefficient. As shown in FIG. 46, when fluid having a lubrication function such as treated oil between a work and a die exists, the friction coefficient depends on the slide speed of a work with a die and tends to decreases as the slide speed increases. In addition, the friction coefficient tends to depend on the slide speed more sufficiently as the contact pressure of a work with a tool increases. Thus, when the contact pressure of a work with a tool increases, the friction coefficient decreases as the slide speed increases. In fact, the contact area of a work with a die is small in draw-forming, so that the contact pressure tends to increase while the contact area is large in bulge-forming, so that the contact pressure tends to decrease.

Figure 48:
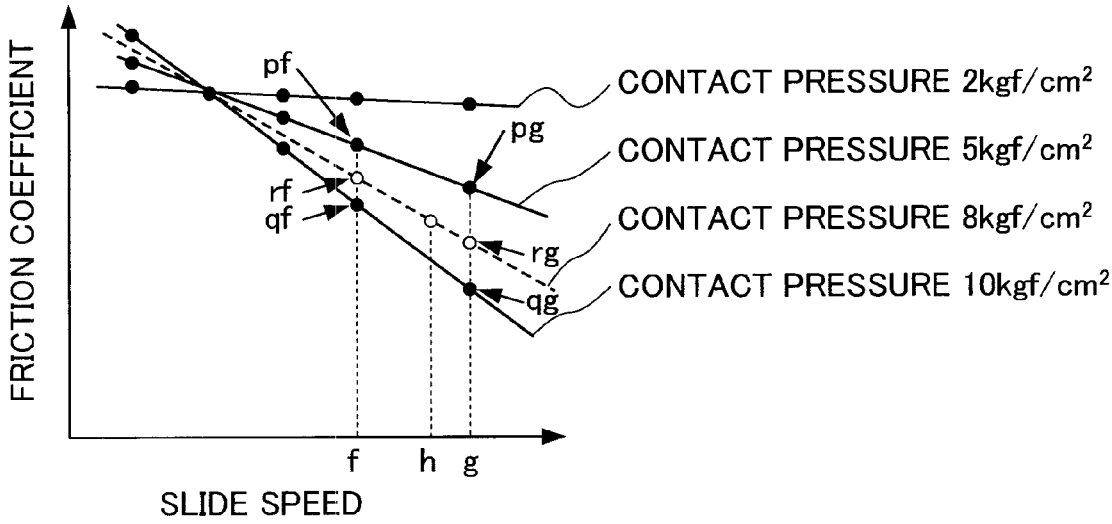
FIG. 48 is a diagram on which dot string data of the friction coefficient according to the embodiment are plotted.

Then, the relationship between the slide speed and the contact pressure, and the friction coefficient is defined as follows. Specifically, as shown in FIG. 47, the relationship between the predetermined slide speed and the predetermined friction coefficient is determined at the predetermined contact pressure by experimentation and the like to generate dot string data. The contact pressure of the predetermined is 1, 2, 5, and 10, and the predetermined slide speed is 1, 5, 10, and 50, 100, and 200, herein. Subsequently, dot string data are plotted on the graph chart as shown in FIG. 48, and then the plotted points are connected with a straight line.

However, when the slide speed and the contact pressure for calculation are not included in the above-mentioned dot string data, the relationship between the slide speed and the contact pressure, and the friction coefficient cannot be determined directly from the dot string data, thus being determined by the following steps. When the slide speed for calculation is located between two slide speeds as defined in FIG. 47, the relationship between the slide speed and the contact pressure, and the friction coefficient is determined by using the interpolation values of these two slide speeds.

When the contact pressure for calculation is located between two contact pressures as defined in FIG. 47, the relationship between the slide speed and the contact pressure, and the friction coefficient is determined by using the interpolation values of these two contact pressures. The above-mentioned interpolation values may be determined by using a direct (linear) function, a quadratic function, or a higher dimensional function.

However, when the contact pressure for calculation is greater than the maximum contact pressure as defined in FIG. 47, the relationship between the slide speed and the contact pressure, and the friction coefficient is used at the defined maximum contact pressure. Meanwhile, when the contact pressure for calculation is less than the minimum contact pressure as defined in FIG. 47, the relationship between the slide speed and the contact pressure, and the friction coefficient is used at the defined minimum contact pressure. Therefore, the extrapolation value of the contact pressure is not used.

For example, as shown in FIG. 48, the dot string data of a contact pressure of 5 kgf/cm$^2$ is defined as pf and pg, and the dot string data of a contact pressure of 10 kgf/cm$^2$ is defined as of and qg. When the friction coefficient at the slide speed h of a contact pressure of 8 kgf/cm$^2$ is determined, the interpolation values of the dot string data at the two contact pressures of 5 kgf/cm$^2$ and 10 kgf/cm$^2$ are the dot string data of a contact pressure of 8 kgf/cm$^2$. Then, among dot string data of this contact pressure of 8 kgf/cm$^2$, the interpolation values of the friction coefficients rf and rg at the respective slide speed f and g are defined as friction coefficients at the slide speed h of a contact pressure of 8 kgf/cm$^2$.

Subsequently, in the step S340, the contact reaction force at the contacted part is calculated. In the step S341, the motion equation of each element is solved. In the step S342, it is determined whether or not it is the time to finish. If the determination is "No", the process returns to the step S332. If the determination is "Yes" the result is output (step S343), and then the process ends. This output result includes the sheet thickness decrease rate to be the index of cracks and the minimum principal strain to be the indices of wrinkles and surface strain.

The present embodiment provides the following effects.

(3) The forming condition determination system 301 is provided with the forming condition optimization means 311, the forming simulation means 312, and the press control data generation means 313. Accordingly, the die cushion pressure and the slide speed can be automatically determined, so that the number of times of trials using a real pressing machine and a real material can be reduced considerably, which leads to reduce the cost. In addition, the forming conditions are expected during the stage of designing the shape of a product, whereby a product with a complex shape can be formed. Especially, in the servo pressing machine 330, the slide speed and the die cushion pressure can be freely changed during forming, so that the number of times of trials can be reduced considerably.

(4) In the forming condition determination means 363, it is determined whether or not the quality of a press-formed article satisfies a certain standard based on the sheet thickness decrease rate and the minimum principal strain, so that the deficiency of a press-formed article is certainly predictable.

(5) The friction coefficient is determined in consideration of the slide speed and the contact pressure of a material with a die of a pressing machine, and the stress-strain relation is determined in consideration of the strain rate. Therefore, forming simulation can be conducted with high accuracy for the servo pressing machine 330 in which the slide speed and the die cushion pressure change.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. For example, in the third embodiment, it is determined whether or not the quality of a press-formed article satisfies a certain standard by using the maximum value of the sheet thickness decrease rate and the minimum principal strain, but not limited thereto. It may be determined whether or not the quality of a press-formed article satisfies a certain standard by using the equivalent plastic strain and the minimum principal strain. This is because when the equivalent plastic strain increases, the crack (fissure) is generated more easily. Specifically, it is determined whether or not the maximum value of the equivalent plastic strain is the predetermined value or less and whether or not the minimum principal strain is the predetermined value or more. If this determination is "Yes", it is determined that the quality of a press-formed article satisfies a certain standard. If this determination is "No", it is determined that the quality of a press-formed article unsatisfies a certain standard.

The invention claimed is:

1. A forming condition determination method for determining a forming speed of a pressing machine, comprising:

a test press-forming step of providing a plurality of measurement points on a sheet material to conduct press-forming of the sheet material with the pressing machine at a predetermined forming speed;

a strain distribution chart plotting step of plotting a strain state at each of the measurement points on the press-formed sheet material on a forming limit diagram including a forming limit curve of the sheet material to produce a strain distribution chart; and a forming speed determination step of defining a closest point plotted on the strain distribution chart to the forming limit curve as a specific measurement point, decreasing the forming speed to be slower than the predetermined forming speed when the specific measurement point is located in a bulge region, and increasing the forming speed to be faster than the predetermined forming speed when the specific measurement point is located in a draw region.

2. A forming condition determination system determining a forming condition of a pressing machine conducting press-forming of a sheet material, the forming condition determination system including an operation processing device, the operation processing device comprising:

a forming simulation part configured to conduct forming simulation under the forming condition including a forming speed;

a strain distribution chart plotting part configured to plot a strain state at each of elements on the press-formed sheet material on a forming limit diagram including a forming limit curve to produce a strain distribution chart, based on a result from the forming simulation part;

a determination part configured to extract a most crackable point among the plotted points as a maximum crack risk point based on a relative position relationship between a point plotted by the strain distribution chart plotting part and the forming limit curve to determine whether the quality of a press-formed article satisfies a certain standard; and a forming speed fluctuation part, when the determination part determines that the quality of the press-formed article does not satisfy a certain standard, configured to increase the forming speed to set the forming condition in the case in which the minimum principal strain at the maximum crack risk point is 0 or less, and decreasing the forming speed to set the forming condition in the case in which the minimum principal strain at the maximum crack risk point is greater than 0, wherein the forming simulation part, the strain distribution chart plotting part, and the determination part are repeated in order until the determination part determines that the quality satisfies a certain standard.

* * * * *